US010619115B2

(12) United States Patent
Swensen et al.

(10) Patent No.: US 10,619,115 B2
(45) Date of Patent: Apr. 14, 2020

(54) COAL-DERIVED SOLID HYDROCARBON PARTICLES

(71) Applicant: EARTH TECHNOLOGIES USA LIMITED, Santa Barbara, CA (US)

(72) Inventors: James S. Swensen, Santa Barbara, CA (US); Simon K. Hodson, Santa Barbara, CA (US)

(73) Assignee: EARTH TECHNOLOGIES USA LIMITED, Santa Barbara, CA (US)

( * ) Notice: Subject to any disclaimer, the term of this patent is extended or adjusted under 35 U.S.C. 154(b) by 0 days.

(21) Appl. No.: 15/809,790

(22) Filed: Nov. 10, 2017

(65) Prior Publication Data

US 2018/0134977 A1 May 17, 2018

Related U.S. Application Data

(60) Provisional application No. 62/421,128, filed on Nov. 11, 2016.

(51) Int. Cl.
*C10L 5/00* (2006.01)
*C10L 1/32* (2006.01)
(Continued)

(52) U.S. Cl.
CPC ..... *C10L 5/00* (2013.01); *C10L 1/322* (2013.01); *C10L 1/326* (2013.01); *C10L 3/003* (2013.01);
(Continued)

(58) Field of Classification Search
CPC ..... C10L 10/02; C10L 10/06; C10L 1/322; C10L 1/326; C10L 2230/22;
(Continued)

(56) References Cited

U.S. PATENT DOCUMENTS 2,842,319 A 7/1958 Reerink et al.
4,270,927 A 6/1981 Burk, Jr. et al.
(Continued)

OTHER PUBLICATIONS

Grimanis, M.P. et al.;Storage, transportation, and atomization of CWF for residential applications.; Jan. 11, 1991; pp. 1-153; Web. doi: 10.2172/10112838; https://www.osti.gov/biblio/10112838-storage-transportation-atomization-cwf-residential-applications-final-report-september-november (Year: 1991).*
(Continued)

*Primary Examiner* — Latosha Hines
(74) *Attorney, Agent, or Firm* — Kirton McConkie; Evan R. Witt

(57) ABSTRACT

The coal-derived solid hydrocarbon particles are discrete particles of coal-derived carbonaceous matter having a particle size less than about 10 μm that are substantially free of inherent or entrained mineral matter. The particles of have an average particle size in the range from 1 μm to 8 μm. The particles of coal-derived carbonaceous matter are milled to a size approximately the same as a size of coal-derived mineral matter inherent in the coal source to release inherent coal-derived mineral matter particles such that the particles of carbonaceous matter and the particles of mineral matter are discrete and separable solid particles. Following separation, less than 1.5 wt. % discrete coal-derived mineral matter particles are associated with the discrete particles of coal-derived carbonaceous matter. Particles of coal-derived solid hydrocarbon matter are blended with a gaseous or liquid hydrocarbon fuel to form a two-phase hydrocarbon fuel feedstock.

20 Claims, 17 Drawing Sheets

(51) Int. Cl.

| | |
|---|---|
| ***C10L 5/36*** | (2006.01) |
| ***C10L 5/04*** | (2006.01) |
| ***C10L 3/00*** | (2006.01) |
| *C10L 10/02* | (2006.01) |
| *C10L 10/06* | (2006.01) |

(52) U.S. Cl.
CPC ..... *C10L 5/04* (2013.01); *C10L 5/366* (2013.01); *C10L 10/02* (2013.01); *C10L 10/06* (2013.01); *C10L 2230/22* (2013.01); *C10L 2250/06* (2013.01); *C10L 2290/24* (2013.01); *C10L 2290/54* (2013.01); *C10L 2290/547* (2013.01)

(58) Field of Classification Search
CPC ..... C10L 2250/06; C10L 2290/24; C10L 2290/54; C10L 2290/547; C10L 3/003; C10L 5/00; C10L 5/04; C10L 5/366
See application file for complete search history.

(56) References Cited

U.S. PATENT DOCUMENTS 4,377,392 A 3/1983 Massey et al.
4,441,887 A * 4/1984 Funk ..... C10L 1/32 406/197
5,022,983 A 6/1991 Meyers et al.
H981 H 11/1991 Venkatachari et al.
5,379,902 A * 1/1995 Wen ..... B03B 9/005 209/166
9,017,432 B2 4/2015 Brooks et al.
2011/0252701 A1 * 10/2011 Soane ..... C10L 5/00 44/621
2013/0091765 A1 * 4/2013 Avant, Jr. ..... B02C 21/00 44/636

OTHER PUBLICATIONS

Wibberly L.J., and Osborne D.; Premium Coal Fuels with Advanced Coal Beneficiation; pp. 1-10; May 2015; Clearwater Clean Coal Conference, Clearwater, FL, vol. 31. 2015.†

Grimanis, M.P., Breault, R.W., Smit, F.J., and Jha, M.C.;Storage, transportation, and atomization of CWF for residential applications.; Jan. 11, 1991; pp. 1-153; Web. doi: 10.2172/10112838; https://www.osti.gov/biblio/10112838-storage-transportation-atomization-cwf-residential-applications-final-report-september-november.†

Xhichao, L., Yanyan, H., Xiaoyan, F., and Yawen, D.; Ultra clean coals laboratory investigation for the Coal; pp. 1-10; Mar. 30, 2010; http://www.paper.edu.cn/releasepaper/content/201003-1050. preparation Plant of Taixi.†

* cited by examiner
† cited by third party

COAL-DERIVED SOLID HYDROCARBON PARTICLES

CROSS-REFERENCE TO RELATED APPLICATION

This application claims the benefit of U.S. Provisional Application No. 62/421,128, filed Nov. 11, 2016, and entitled COAL-DERIVED SOLID HYDROCARBON PARTICLES. This prior application is incorporated by reference.

BACKGROUND OF THE INVENTION

This disclosure relates to coal-derived solid hydrocarbon particles and methods of preparing such particles. Coal-derived solid particles include coal-derived carbonaceous matter and coal-derived mineral matter. Coal-derived solid hydrocarbon particles include discrete solid coal-derived carbonaceous matter particles, derived from any coal source, which are milled to a sufficiently small size to be substantially free of inherent or entrained mineral matter. Systems and methods for the separating coal-derived carbonaceous matter particles from coal-derived mineral matter particles are disclosed. The resulting coal-derived solid hydrocarbon particles are substantially free of inherent or entrained coal-derived mineral matter.

Coal is a solid fossil fuel formed from ancient plant materials. Coal contains varying amounts of carbon, hydrogen, nitrogen, oxygen, and sulfur as well as varying amounts of other elements and compounds, including mineral matter. Mined coal rocks are a composite material composed of three general categories of substances: organic carbonaceous matter, including macerals; inorganic mineral matter; and fluids. The carbonaceous matter includes solid hydrocarbons of different molecular weights. The mineral matter includes the ash-forming mineral content of coal. The mineral matter dispersed through the coal-derived solid carbonaceous matrix is referred to as inherent mineral matter or inherent ash. Mineral matter which originates from the inter-seam bands or the roof and floor strata during mining is referred to as extraneous ash. The fluids occur in pores within and between the other two solid constituents. The fluids in coal prior to mining are mainly water and methane. Water typically ranges from 10 to 50 wt. %.

Mined coal is passed through a preparation plant to crush the coal to the proper size for shipment and to remove bulk extraneous ash (inorganic mineral formations layers, nodules, fissures, and rock fragments) associated with mined coal. Additionally, coal rocks with too much inherent ash (disseminated or entrained mineral matter, fine inclusions of mineral matter in the solid hydrocarbon matrix) are also screened out via density separation techniques. The materials removed from mined coal rock in a preparation plant are sent to an impoundment as waste coal refuse.

Coal is one of the most important energy sources in the world. Approximately 1 billion tons of coal are produced in the United States each year. Coal is typically crushed. During the mining and crushing operation, coal waste fines, also known as coal dust, are generated. Furthermore, coal is typically washed prior to transport to remove surface dust. Coal fines are defined as coal that is less than 1 millimeter in size, and coal ultrafines are defined as coal that is less than 500 microns in size. The current industrial process to recover coal particles less than 1 mm in size is more expensive than other coal processing. The smaller the particles, the greater the processing cost. Further, there are no current commercial processes to recover and sell particles less than 100 microns (0.1 mm). Approximately 200 to 300 million tons of coal waste fines are produced and impounded each year in the United States. It is estimated that over 3 billion tons of coal are produced in China each year, and over 500 million tons of associated coal fines are impounded each year.

There are many grades of coal based on the mineral matter ash content, moisture, macerals, hydrocarbon, and volatile matter. Regardless of grade of coal, the energy content of coal is directly correlated to its moisture and ash-forming mineral matter contents. The lower the ash-forming mineral matter and moisture content of the coal, the greater the energy content and the higher the value of the coal. Coal of any grade can be improved through reducing the mineral matter component content of the coal.

While coal fines are the same chemical composition of the larger-size mined coal product, it is considered waste because the conventional coal recovery process is not designed to handle small particles. The waste coal fines are left unused because they are typically too wet to burn, too dirty to be worth drying, and too fine to transport. There are billions of tons of waste coal fines impounded at thousands of coal mines throughout the world. It is estimated there are over 10 billion tons in the United States and China, and billions of additional tons in Australia, India, Indonesia, Russia, Colombia and other countries.

As used herein, coal fines generally contain three components: (1) solid hydrocarbon; (2) solid mineral matter, which includes ash-forming component particles, such as clay, limestone, and sand; and (3) water. These coal fines typically have a mineral matter content of greater than 30%, by weight (about 15% by volume), and a moisture content of greater than 30%, by weight. They are often impounded as environmentally hazardous.

Of particular challenge in the coal industry is the burning of coal with typical ash-forming mineral matter components. The components are the major source of most harmful emissions, such as $SO_x$, and reduce energy value and heat transfer efficiency. Removing or separating the solid mineral matter components from the solid hydrocarbon components would enable the preparation of a cleaner burning coal product and would be a significant advancement in the energy sector. Substantially pure solid hydrocarbon component of coal may also be useful in chemical, industrial, and energy applications that were previously unsuitable for solid coal when it was in the state of coal rock and coal particles.

It would be an advancement in the art to provide methods of obtaining coal-derived solid hydrocarbon particles which are substantially free of coal-derived mineral matter.

BRIEF SUMMARY OF THE INVENTION

Naturally occurring solid coal is a composite solid material consisting of solid organic carbonaceous matter and solid inorganic mineral matter dispersed through the carbonaceous matter matrix. Water and volatile fluids may also be present in coal. Thus, coal-derived solid particles include coal-derived solid carbonaceous matter and coal-derived solid mineral matter. This disclosure relates to methods and systems for separating coal-derived solid mineral matter particles from the solid carbonaceous matter to yield coal-derived solid hydrocarbon particles that are substantially free of inherent mineral matter.

As used herein, coal-derived solids include discrete particles which may originate from any coal source. They include, but are not limited to, discrete coal-derived carbonaceous matter particles, discrete non-hydrocarbon mineral matter particles, coal-derived agglomerate particles containing solid carbonaceous matter and mineral matter particles, coal-derived composite particles containing solid carbonaceous matter and mineral matter phases, all of which may originate from any processed or unprocessed coal source. The coal-derived composite particles are also referred to herein as "composite coal."

As used herein, coal-derived solid hydrocarbon particles include discrete solid coal-derived carbonaceous matter particles, derived from any coal source, which are substantially free of inherent mineral matter. Coal sources may include, but are not limited to, mined coal, coal refuse, run of mine coal, upgraded run of mine coal, coal refuse from coal processing, coal refuse in slurry ponds, crushing and milling of mined coal.

As used herein, coal-derived solid mineral matter includes discrete solid non-hydrocarbon mineral matter particles derived from any coal source. Coal sources may include, but are not limited to, mineral matter derived from mined coal, coal refuse, run of mine coal, upgraded run of mine coal, coal refuse from coal processing, coal refuse in slurry ponds, crushing and milling of mined coal.

As used herein, coal-derived solid hydrocarbon particles are substantially free of inherent or entrained mineral matter particles. In one embodiment, the coal-derived solid hydrocarbon particles comprise discrete particles of coal-derived carbonaceous matter having a particle size less than about 20 μm. In another embodiment, the discrete particles of coal-derived carbonaceous matter have a particle size less than about 10 μm. The particles of coal-derived carbonaceous matter may have an average particle size in the range from 1 μm to 4 μm. The particles of coal-derived carbonaceous matter are milled to a size approximately the same as a size of coal-derived mineral matter inherent in the coal source to release inherent coal-derived mineral matter particles such that the particles of carbonaceous matter and the particles of mineral matter are discrete solid particles. Being separate, individually distinct, or unconnected, the coal-derived carbonaceous matter particles are separated from the coal-derived mineral matter particles to yield substantially pure coal-derived carbonaceous matter particles or, as used herein, coal-derived solid hydrocarbon particles. Because of limitations associated with processes to separate discrete coal-derived carbonaceous matter particles from discrete coal-derived mineral matter particles, there may be a small amount of discrete coal-derived mineral matter particles that remain unseparated from the discrete coal-derived carbonaceous matter particles. Typically less than 1.5 wt. % discrete coal-derived mineral matter particles are unseparated from coal-derived carbonaceous matter particles. As improved separation processes are developed, the amount of coal-derived mineral matter particles remaining unseparated from the coal-derived mineral matter particles will decrease. Such substantially pure coal-derived carbonaceous matter particles are referred to herein as coal-derived solid hydrocarbon. Because the coal-derived solid hydrocarbon particles are substantially free of inherent or entrained mineral matter, coal-derived solid hydrocarbon is not composite coal. As used herein, the expression "discrete particles" or "discrete solid particles" means solid particles that are separate, individually distinct, or unconnected.

In some non-limiting embodiments, there may be less than 1 wt. % discrete coal-derived mineral matter particles remaining unseparated from particles of coal-derived carbonaceous matter. In some non-limiting embodiments, there may be less than 0.7 wt. % discrete coal-derived mineral matter particles remaining unseparated from particles of coal-derived carbonaceous matter.

The particles of coal-derived carbonaceous matter may be present in a filter cake comprising the particles of coal-derived carbonaceous matter and a liquid hydrocarbon. Non-limiting examples of liquid hydrocarbon include kerosene, diesel, fuel oil, and crude oil.

The coal-derived solid hydrocarbon particles may be used in a variety of different applications. In one embodiment, the particles of coal-derived carbonaceous matter are blended with a hydrocarbon fuel to form a two-phase hydrocarbon fuel feedstock. The hydrocarbon fuel may be liquid or gaseous. In another embodiment, the particles of coal-derived carbonaceous matter are blended with water to form a two-phase liquid fuel feedstock.

Methods for obtaining coal-derived solid hydrocarbon particles are disclosed herein. In one non-limiting method, coal-derived solids comprising discrete particles of coal-derived composite composed of a solid carbonaceous matter matrix and inherent mineral matter in the carbonaceous matter matrix are separated from discrete particles of coal-derived mineral matter using froth flotation. Non-limiting examples of useful froth flotation separations techniques are disclosed in copending U.S. patent application Ser. No. 14/495,657, published as U.S. Publication No. US 2016/0082446 A1, which disclosure is incorporated by reference.

The quality and characteristics of the aqueous slurry feed used in froth flotation affects the coal-froth produced. In one non-limiting embodiment, an aqueous slurry of coal-derived solids is obtained comprising discrete particles of coal-derived composite composed of a solid carbonaceous matter matrix and inherent mineral matter in the carbonaceous matter matrix, discrete particles of coal-derived mineral matter, and a quantity of water. The aqueous slurry may contain greater than 25 wt. % solid particles comprising the discrete particles of coal-derived composite and discrete particles of coal-derived mineral matter. The discrete particles of coal-derived composite and discrete particles of coal-derived mineral matter have a particle size less than about 100 μm.

The particles of coal-derived composite may be separated from the particles of coal-derived mineral matter via a froth flotation separation to yield a coal-froth. The coal-froth typically contains less than 8 wt. % coal-derived mineral matter on a dry basis. In some embodiments, the coal-froth contains less than 5 wt. % coal-derived mineral matter on a dry basis. In other embodiments, the coal-froth contains less than 2.5 wt. % coal-derived mineral matter on a dry basis. Water is mechanically removed from a portion of the coal-froth to yield a wet filter cake. Any suitable mechanical liquid/solid separation technique may be used to separate liquid from the solid particles. A filter press and vacuum filtration are two non-limiting examples of mechanical liquid removal techniques that may be used herein. The wet filter cake is preferably blended with another portion of the coal-froth to form a mixture containing from 45 to 55 wt. % solids.

A dispersant is preferably added to the mixture to reduce particle agglomeration and enable subsequent froth flotation, if desired. In one non-limiting embodiment, the dispersant is an organic acid. The dispersant may be an organic acid selected from linear, cyclic, saturated, or unsaturated carboxylic acid and polycarboxylic acids. In one currently preferred embodiment, the dispersant is citric acid. The dispersant preferably inhibits oxidation of the carbonaceous matter matrix of the coal-derived composite particles.

The mixture may be milled to form discrete particles of coal-derived solid hydrocarbon and discrete particles of coal-derived mineral matter having an average particle size in the range from 1 μm to 8 μm. In one non-limiting embodiment, the mixture is milled using ceramic media having a size less than 5 mm.

In one embodiment, the milled mixture is combined with a liquid hydrocarbon to form a suspension. Non-limiting examples of the liquid hydrocarbon include diesel, kerosene, fuel oil, and crude oil. The suspension may comprise at least 50 wt. % solid particles with respect to the liquid hydrocarbon. The water containing suspended hydrophilic coal-derived mineral matter is more dense and is drained off the bottom. The liquid hydrocarbon containing suspended solid hydrocarbon is less dense and floats on top. Once the bulk water is drained off, excess liquid hydrocarbon and any remaining water are removed via a mechanical liquid/solid separation process, such as a filter press, to yield a hydrocarbon filter cake comprising particles of coal-derived solid hydrocarbon and liquid hydrocarbon. The filter cake may comprise less than 2 wt. % coal-derived mineral matter on a dry basis. In another embodiment the hydrocarbon filter cake may comprises less than 1 wt. % coal-derived mineral matter on a dry basis. A filter press and vacuum filtration are two non-limiting examples of mechanical liquid/solid separation techniques that may be used separate the liquids from the solid particles.

The hydrocarbon filter cake may be used in a variety of different industrial, chemical, and energy applications. In one non-limiting embodiment, the hydrocarbon filter cake may be blended with a liquid hydrocarbon fuel to form a two-phase hydrocarbon fuel feedstock.

In another embodiment, the milled mixture is subjected to a second froth flotation separation process to separate the milled particles of coal-derived solid hydrocarbon from the particles of coal-derived mineral matter. A coal-derived solid hydrocarbon (CDSH)-froth is produced that contains less than 2 wt. % coal-derived mineral matter on a dry basis. In one embodiment, water is mechanically removed from the CDSH-froth to yield a wet CDSH filter cake, containing coal-derived solid hydrocarbon particles suitable for use in water-fuel suspensions.

In another embodiment, wet CDSH filter cake, containing coal-derived solid hydrocarbon particles is dried to produce dry CDSH powder. This powdered coal-derived solid hydrocarbon can be used as a feedstock into industrial, chemical, and energy processes and applications. The dry CDSH powder can be directly injected into a combustor as a fuel source. The dry CDSH powder can be suspended in air or a gaseous fuel as a two-phase fuel source.

In another disclosed method for obtaining coal-derived solid hydrocarbon particles, an aqueous slurry of coal-derived solids is obtained comprising discrete particles of coal-derived composite composed of a solid carbonaceous matter matrix and inherent mineral matter in the carbonaceous matter matrix, discrete particles of coal-derived mineral matter, and a quantity of water. The aqueous slurry of coal-derived solids, at about 50 wt. % solids, is milled to less than 20 microns with an average particle size between about 2 microns to 4 microns. A dispersant is preferably added to the aqueous slurry prior to milling to reduce particle agglomeration and enable subsequent froth flotation. In one non-limiting embodiment, the mixture is milled using ceramic media having a size less than 5 mm. The milled slurry is introduced into a froth flotation cell. The froth produced is then floated again in a second flotation step. The second flotation largely removes all free floating coal-derived mineral matter such that the second froth contains very little free coal-derived mineral matter. Because the second froth contains coal-derived solid hydrocarbon (CDSH), it is termed CDSH-froth.

The milled mixture is optionally subjected to a single froth flotation separation process to separate the milled particles of coal-derived solid hydrocarbon from the particles of coal-derived mineral matter. In this case, the coal-derived mineral matter solids content in the pulp may be continually diluted to less than 4 wt. % solids to minimize the free coal-derived mineral matter available for entrainment in the CDSH-froth being produced. The coal-derived mineral matter content of the froth is less than 1.5 wt. % on a dry basis. Further, counter-current wash water may be dripped over the CDSH-froth. The CDSH-froth with counter current wash water may be less than 0.5 wt. % coal-derived mineral matter particles on a dry basis.

Water may optionally be mechanically removed from the CDSH-froth to yield a wet CDSH filter cake using a suitable mechanical liquid/solid separation technique, such as those mentioned above.

The wet filter cake may be blended with water to form a two-phase liquid fuel.

The wet filter cake may be dried to yield dried coal-derived solid hydrocarbon powder. Such CDSH powder may be blended with and suspended in a hydrocarbon fuel to form a two-phase hydrocarbon fuel feedstock. The hydrocarbon fuel may be gaseous, such as natural gas, methane, propane, butane, or other gaseous hydrocarbon fuel. The dried coal-derived solid hydrocarbon particles may be blended with and suspended in air to form a two-phase gaseous fuel.

Instead of mechanically removing water from the CDSH-froth, it may be combined with a liquid hydrocarbon to form a suspension, as described above. Non-limiting examples of the liquid hydrocarbon include diesel, kerosene, fuel oil, and crude oil. The suspension may comprise at least 50 wt. % solid particles with respect to the liquid hydrocarbon. The water phase containing suspended hydrophilic coal-derived mineral matter is more dense and is drained off the bottom. The liquid hydrocarbon phase containing suspended CDSH is less dense and floats on top. Once the bulk water is drained off, excess liquid hydrocarbon and any remaining water are removed via a mechanical liquid/solid separation process, such as a filter press, to yield a hydrocarbon filter cake comprising particles of coal-derived solid hydrocarbon and liquid hydrocarbon. The hydrocarbon filter cake can be transported as a solid to be used as a feedstock in other industrial and chemical processes and applications. In addition, it may be used to prepare liquid hydrocarbon-based fuels.

BRIEF DESCRIPTION OF THE SEVERAL VIEWS OF THE DRAWINGS

In order that the manner in which the above-recited and other features and advantages of the invention are obtained will be readily understood, a more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

The present embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the invention is not intended to limit the scope of the invention, as claimed, but is merely representative of present embodiments of the invention.

One aspect of the disclosed invention relates to methods and systems for separating coal-derived mineral matter inherent or entrained in coal from the solid carbonaceous matter to yield coal-derived solid hydrocarbon particles that are substantially free of inherent mineral matter. This is facilitated by forming discrete particles of coal-derived mineral matter and discrete particles of coal-derived carbonaceous matter.

Being separate, individually distinct, or unconnected, the coal-derived carbonaceous matter particles are separated from the coal-derived mineral matter particles to yield substantially pure coal-derived carbonaceous matter particles The following non-limiting examples are given to illustrate several embodiments relating to the disclosed coal-derived solid hydrocarbon particles and related methods. It is to be understood that these examples are neither comprehensive nor exhaustive of the many types of embodiments which can be practiced in accordance with the presently disclosed invention.

Example 1

Figure 1:
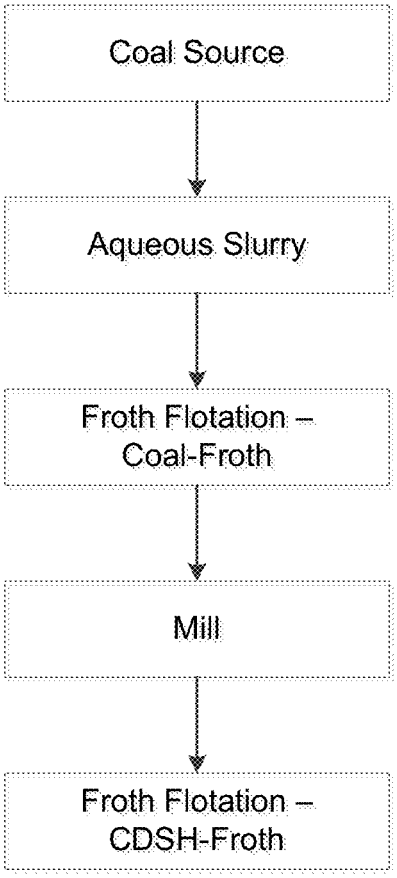
FIG. 1 is a flow diagram of a disclosed process for obtaining a coal-derived solid hydrocarbon froth.

As illustrated in FIG. 1, an aqueous slurry of coal-derived solids, which may originate from any coal source, was obtained. The aqueous slurry comprised discrete particles of composite coal composed of a solid carbonaceous matter matrix and inherent mineral matter in the carbonaceous matter matrix, discrete particles of coal-derived mineral matter, and a quantity of water. The slurry containing approximately fifty weight percentage (wt. %) solid particles was introduced into a high shear mixer.

The slurry was then discharged over a 300 micrometer (μm) screen on an orbital sieve. The underflow from the 300 μm screen was introduced into a coal-froth flotation cell where particles of composite coal were separated from particles of coal-derived mineral matter by froth flotation separation. Composite coal particles attached to fine bubbles in the water-bubble region, often called the pulp of the flotation cell. The buoyancy force of the bubble lifted the bubble and composite coal particle to the top of the flotation cell which is called the water-bubble line. At the water-bubble line, small bubbles coalesce into larger bubbles forming a coal-froth. Composite coal particles stay adhered to the coalesced bubbles in the coal-froth. The coal-froth was formed in an upper region of the coal flotation cell above the pulp at the water-bubble line. The coal-derived mineral matter particles remained in the pulp in the lower region of the coal flotation cell since they are hydrophilic. As more coal-laden bubbles reached the water-bubble line and coalesced into coal-froth, a net upward force of incoming coal-laden bubbles pushed the froth up and over the top of the flotation cell where it was collected for further processing.

In one embodiment, the coal-froth comprised approximately 4.5 wt. % solid coal-derived mineral matter particles on a dry basis. In another embodiment, the coal-froth comprised approximately 8 wt. % solid coal-derived mineral matter particles on a dry basis. This range is dependent on the quality of the initial coal refuse.

The coal-froth was then passed through a mill to reduce its particle size. The average particle size of the composite coal particles exiting the mill can be determined based on the incoming particle size, the solids content of the incoming coal-froth, the residence time of the coal-froth in the mill, and the media size used in the mill.

The milled coal-froth was then floated again. The milling process liberated coal-derived mineral matter that was entrained in the larger composite coal particles. Refloating a milled coal-froth that was previously floated produced a lower coal-derived mineral matter content of the coal than was obtained from the first flotation at a larger particle size. After milling and the secondary flotation, the froth contained coal-derived solid hydrocarbon (CDSH) and is termed, CDSH-froth. In this example, the CDSH-froth comprised between 0.47 wt. % and 1.42 wt. % coal-derived mineral matter particles on a dry basis when the particle size was less than 20 microns with an average particle size of 2 to 4 microns respectively. In general, the CDSH-froth from the second flotation contained from 75 wt. % to 50 wt. % moisture and a coal-derived mineral matter particle content of between 0.5 wt. % and 1.5 wt. % on a dry basis.

Solid particles in the CDSH-froth of the second flotation comprising less than 1.5 wt. % discrete coal-derived mineral matter particles, comprising less than 1 wt. % discrete coal-derived mineral matter particles, and comprising less than 0.5 wt. % discrete coal-derived mineral matter particles are considered to be a new material apart from the naturally occurring composite coal material from which it was derived, because the mineral matter has been largely removed via a refining or purification process. This new hydrocarbon material is referred to in herein as coal-derived solid hydrocarbon (CDSH). As will be shown later with SEM data, the CDSH particles are discrete from the coal-derived mineral matter particles. The mineral matter that remains is no longer inherent or entrained in a composite coal particle. CDSH is a new material of discrete particles of carbonaceous material derived from coal that no longer has any inherent or entrained mineral matter.

Example 2

Figure 2:
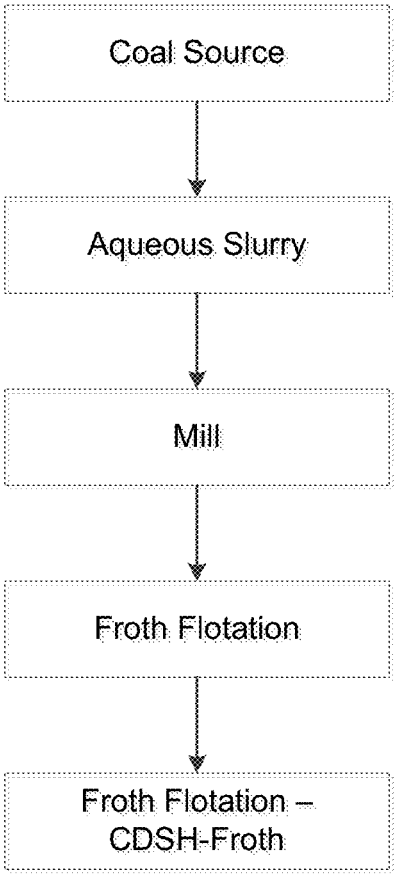
FIG. 2 is a flow diagram of another disclosed process for obtaining a coal-derived solid hydrocarbon froth.

As an alternative to the process described in Example 1, and as illustrated in FIG. 2, prior to the first froth flotation, the entire aqueous slurry of coal-derived solids, at about 50 wt. % solids, was milled to less than 20 microns with an average particle size between about 2 microns to 4 microns. This milled slurry was then introduced into a froth flotation cell. The froth produced was then floated again in a second flotation step, similar to Example 1. The first flotation removed the bulk of the free coal-derived mineral matter. However, some of the free coal-derived mineral matter was communicated to the first froth in the water. The reason for this is that the source of the water in the froth is the water in the pulp of the flotation cell. The pulp of the flotation cell also contains the hydrophilic coal-derived mineral matter in suspension. As water is included in the froth phase, so is coal-derived mineral matter in that water. The second flotation served to largely remove all free floating coal-derived mineral matter such that the second froth contained very little free coal-derived mineral matter.

In this example, all particles intended for froth flotation were milled to be less than 20 microns. The slurry with all particles less than 20 microns was floated to produce a first froth. The first froth had too much coal-derived mineral matter (about 8 to 10 wt. %), so the first froth was then immediately refloated to produce a second froth that was largely free of liberated coal-derived mineral matter. The second froth contained coal-derived solid hydrocarbon (CDSH) and is termed, CDSH-froth. The CDSH-froth comprised between 0.49 wt. % and 1.48 wt. % coal-derived mineral matter particles on a dry basis when the particle size was less than 20 microns, with an average particle size of 2 to 4 microns, respectively.

As demonstrated in this example, coal-derived solid hydrocarbon particles can be produced by first milling the aqueous slurry of coal-derived solids such that all particles are less than 20 microns with an average particle size between about 2 microns to 4 microns, and then floating the milled slurry to yield a coal-froth. The coal-froth was then floated to yield a CDSH-froth comprising coal-derived solid hydrocarbon.

It will be appreciated that the primary difference between Example 1 (FIG. 1) and Example 2 (FIG. 2) is whether milling occurs before or after a froth flotation step.

Example 3

Figure 3:
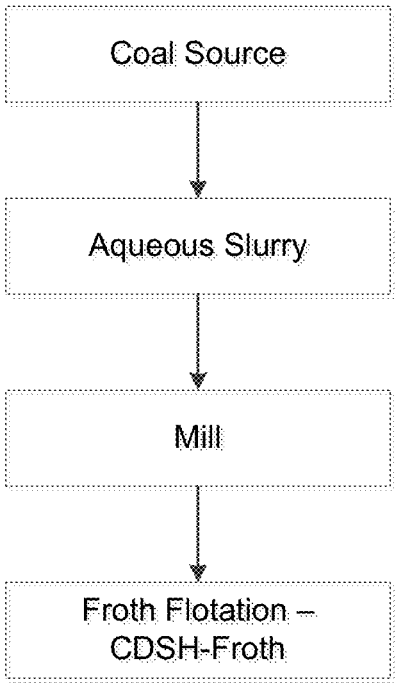
FIG. 3 is a flow diagram of yet another disclosed process for obtaining a coal-derived solid hydrocarbon froth.

As an alternative to the process described in Examples 1 and 2, and as illustrated in FIG. 3, prior to the first flotation, the entire aqueous slurry of coal-derived solids was milled to less than 10 microns with an average size of about 2 microns. This milled slurry was then introduced into a froth flotation cell. In this case, the solids content in the pulp was continually diluted to less than 4 wt. % solids to minimize the free coal-derived mineral matter available for entrainment in the froth being produced. The coal-derived mineral matter content of the froth was 1.08 wt. % on a dry basis. Further, counter-current wash water was dripped over the CDSH-froth. The CDSH-froth with counter current wash water contained 0.46 wt. % coal-derived mineral matter particles on a dry basis.

In this example, coal-derived solid hydrocarbon can be produced by first milling the slurry such that all particles are less than 10 microns with an average size of about 2 micron. By maintaining the proper conditions during flotation, the slurry was floated, and no further flotation of the froth was needed to produce a CDSH-froth containing coal-derived solid hydrocarbon. The CDSH-froth containing water and coal-derived solid hydrocarbon particles was a pumpable, two-phase system.

Example 4

Figure 4:
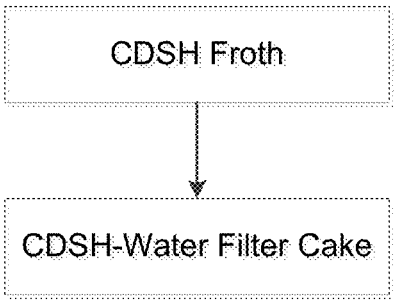
FIG. 4 is a flow diagram of a disclosed process for obtaining a coal-derived solid hydrocarbon filter cake.

Referring to FIG. 4, the CDSH-froth containing coal-derived solid hydrocarbon particles, such as produced in Examples 1-3 above, was mechanically dewatered using a filter press to produce a CDSH-water filter cake. The CDSH-water filter cake has a moisture content range from 35 wt. % to 45 wt. %. The CDSH-water filter cake is a two-phase system composed of coal-derived solid hydrocarbon particles and liquid water. The CDSH-filter cake can be used as a feedstock into other processes including pelletization, water based liquid fuels, and making a powder of dry coal-derived solid hydrocarbon.

Example 5

Figure 5:
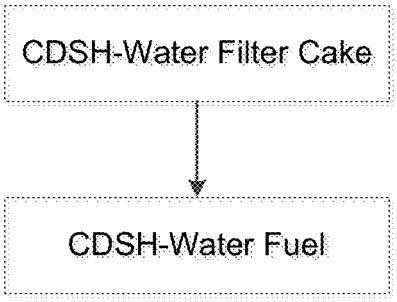
FIG. 5 is a flow diagram of a disclosed process for preparing a coal-derived solid hydrocarbon and water fuel.

Referring to FIG. 5, coal-water fuel is a name given to a mixture of coal particles and water that can be pumped and consumed as a fuel even though the inclusion of significant amounts of water in a fuel source is counter-intuitive. If there are enough coal particles of a size that enable to slurry to be pumped, and if the appropriate combustor is used, the coal-water fuel can be burned. The water does have a negative impact on heat content because some of the energy of the coal is consumed in the vaporization of the water. As a result, the lower the water content while still maintaining a stable suspension of particles, the higher the energy content of the coal water fuel. Moisture contents generally range from 40 to 55 wt. % water. The coal-derived mineral matter content of known coal-water fuels is generally 10 wt. % or more, as that is the standard coal-derived mineral matter content of the coal particles being used.

Similarly, a new two phase, pumpable fuel consisting of liquid water and coal-derived solid hydrocarbon was made. The coal-derived solid hydrocarbon particles were all less than 20 microns in diameter with an average particle size of 4 microns. A dispersant was used to keep the particles in suspension and minimize viscosity of the suspension. The moisture content ranged from 38 wt. % moisture to 55 wt. % moisture depending on the desired viscosity. Non-limiting examples of dispersants that may be used to make a stable, pumpable fuel consisting of liquid water and dispersed coal-derived solid hydrocarbon particles include organic acids, e.g. citric acid, polyethers, e.g. polyethylene oxide, and lignosulfonates. The dispersant was used at loading levels in the range of about 0.5 wt. % and 1 wt. %.

Since the coal-derived mineral matter content of the coal-derived solid hydrocarbon was less than 1.5 wt. %, and in some cases less than 0.5 wt. %, on a dry basis, when the pumpable fuel consisting of water and coal-derived solid hydrocarbon was burned in an appropriate combustor, e.g. a pulse jet combustor is one example, the coal was burned completely and all of the water was vaporized. The products of the combustion process were nearly all $CO_2$ and water vapor, with small amounts $SO_x$ and $NO_x$, depending on the existence of trace amounts of sulfur and nitrogen in the coal-derived solid hydrocarbon particles.

Example 6

A pumpable CDSH-water fuel consisting of water and coal-derived solid hydrocarbon particles was made similar to Example 5, except that particle packing was used to reduce the water content of the stable, pumpable CDSH-water fuel. A bimodal distribution of coal-derived solid hydrocarbon particles was used to make the pumpable fuel. According to particle packing theory, a spherical particle of uniform shape will fill about 65 vol. % of space with the remaining 35% of the volume being void or free space. The void space in between all of these particles can be filled with smaller particles. If a particle with a diameter at least 10 times smaller is used, the void space can be considered free space by the smaller particles. As a result, 65% of the free void space can be filled with the smaller particle. Since 35% of the volume is void space in between particles and the smaller particles can fill 65% of this space, 22 vol. % (35% free void space*65% fill factor) is filled by the smaller particles (at least 10× smaller diameter than the larger particles).

In this bimodal system, 65% of the volume was the larger particles, and 22% of the volume was the smaller particles. As a result, 87 vol. % of free space was filled with CDSH particles. Water (between 15 vol. % up to 25 vol. %) and dispersant (between 0.5% and 1%) were blended with the bimodal distribution of coal-derived solid hydrocarbon particles to produce a stable, pumpable, and liquid fuel consisting of water and coal-derived solid hydrocarbon particles with a desired viscosity.

A bimodal distribution of coal-derived solid hydrocarbon was used to make a pumpable two-phase liquid fuel composed of liquid water and coal-derived solid hydrocarbon particles with a lower water content than a system with just one particle size. The moisture content ranged from 15 vol. % to 25 vol. % depending on the targeted viscosity.

Example 7

A pumpable CDSH-water fuel consisting of water and coal-derived solid hydrocarbon particles is made similar to Example 5, except that particle packing is employed to reduce the water content of the stable, pumpable CDSH-water fuel. A trimodal distribution of coal-derived solid hydrocarbon particles and water is used to make the pumpable fuel. In other words, three distinct particle sizes are used to make the trimodal distribution particle sizes for particle packing purposes. Based upon the particle packing theory described above, 65% of the volume is filled with large particles, 22% of the volume (35% free void space*65% fill factor) is filled with medium particles (10 times smaller than the large particles), and 8% of the volume (13% free void space*65% fill factor) is filled with small particles (at least 100 time smaller diameter than the large particles and at least 10× smaller diameter than the medium particles).

In one trimodal system, a pumpable fuel consisting of water and 65% of the volume is the large particles, 22% of the volume is the medium particles, and 8% of the volume is the small particles. As a result, 95 vol. % of free space is filled with coal-derived solid hydrocarbon. 5 vol. % remains as free void space. The average particle sizes are 10 microns, 1 micron, and 0.1 micron respectively. Water (7 vol. % up to 12 vol. %) and dispersant (between 0.5 wt. % and 1% wt. %) are blended with the trimodal distribution of coal-derived solid hydrocarbon particles to produce a stable, pumpable fuel consisting of water and coal-derived solid hydrocarbon particles with a desired viscosity and a moisture content less than 15 vol. % water.

In another trimodal system, a pumpable fuel consisting of water and a trimodal distribution of particles is made where the large particles are composite coal particles having an average particle size of 100 microns. The coal-derived mineral matter content of these particles is about 4.5 wt. %. The average particle size of the medium particles is about 10 microns with a coal-derived mineral matter content of 0.9 wt. %. The average particle size of the small particles is about 1 micron with a coal-derived mineral matter content of 0.3 wt. %. The medium and small particles are coal-derived solid hydrocarbon because they do not contain inherent or entrained mineral matter and the coal-derived mineral matter particles remaining unseparated from the coal-derived solid hydrocarbon is present at less than 1 wt. %. Water (7 vol. % up to 12 vol. %) and dispersant (between 0.5 wt. % and 1 wt. %) are blended with the trimodal distribution of particles to produce a stable, pumpable fuel consisting of water, coal-derived solid hydrocarbon particles and composite coal particles, with a desired viscosity and a moisture content less than 15 vol. % water. This is a hybrid fuel that blends composite coal particles and coal-derived solid hydrocarbon particles together to create a stable, pumpable liquid fuel.

A trimodal distribution of coal-derived solid hydrocarbon is used to make a pumpable two-phase liquid fuel composed of liquid water and coal-derived solid hydrocarbon particles with a lower water content than a system with just one particle size. The moisture content ranges from about 7 vol. % to 12 vol. % depending on the targeted viscosity.

Example 8

Figure 6:
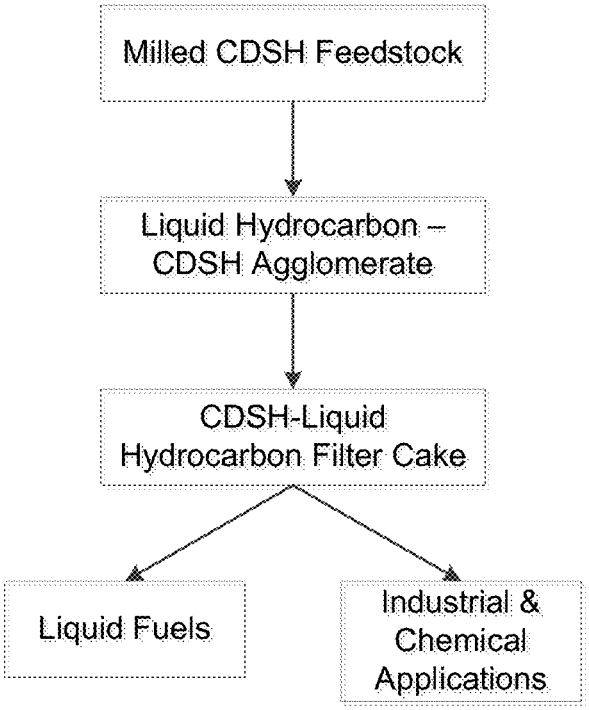
FIG. 6 is a flow diagram of a disclosed process using hydrocarbon agglomeration.

Referring to FIG. 6, an agglomeration step with a liquid hydrocarbon was performed to separate CDSH from water and coal-derived mineral matter using various liquid hydrocarbons. The different liquid hydrocarbons used in this example were kerosene, diesel, toluene, hexane, pentane, motor oil, and vegetable oil. The invention is not limited to these liquid hydrocarbons. A key requirement for the agglomeration step was that the liquid hydrocarbon not be miscible with water so that the liquid hydrocarbon and water would separate into two distinct liquid phases after mixing. In addition, the liquid hydrocarbon is preferably hydrophobic in nature to drive the process.

The milled product from Example 1, the coal-froth (first froth) from Example 2, the milled product from Example 3, and the coal-derived solid hydrocarbon froth produced from Examples 1, 2, or 3 was used as a feedstock into the agglomeration step. One of these water and solid particle suspensions was mixed with liquid hydrocarbon, e.g. diesel, such that there would be more than 40 wt. % solids coal-derived solid hydrocarbon particles with respect to the liquid hydrocarbon. The water solid particle suspension was thoroughly mixed with the liquid hydrocarbon. In one non-limiting embodiment, the mixer used was a high speed in-line mixer. The mixer was then turned off. The mixture then separated into a more dense water/coal-derived mineral matter phase on bottom and a less dense liquid hydrocarbon/coal-derived solid hydrocarbon phase on top. The coal-derived solid hydrocarbon agglomerated via hydrophobic interaction in the less dense hydrophobic phase on top of the water. Liberated mineral matter in the suspension remained suspended in the water phase due to hydrophilic interactions. The water with suspended mineral matter in the lower phase was drained off. The amount of coal-derived mineral matter remaining unseparated from the coal-derived solid hydrocarbon in this example was shown to be between 0.3 wt. % and 0.8 wt. % on a dry basis.

To speed up the removal of water from the liquid hydrocarbon and coal-derived solid hydrocarbon, an oil water separator can be used.

A new two-phase pumpable slurry was prepared after the agglomeration step consisting of a liquid hydrocarbon and the coal-derived solid hydrocarbon. The solid content of was greater than 40 wt. % solid.

Example 9

Referring to FIG. 6, the two-phase slurry of liquid hydrocarbon and coal-derived solid hydrocarbon particles from Example 8 was pumped into a filter press. Excess liquid hydrocarbon was removed to produce a filter cake consisting of a liquid hydrocarbon and a coal-derived solid hydrocarbon. The filter cake contained about 20 to 30 wt. % liquid hydrocarbon. In instances where water was not completely removed from the liquid hydrocarbon and coal-derived solid hydrocarbon suspension described in Example 8, the water was completely removed in this example because the high pressure conditions in the filter press preferentially expelled the hydrophilic water from the hydrophobic agglomeration of the liquid hydrocarbon and the coal-derived solid hydrocarbon.

The filter cake was a solid two phase system of liquid hydrocarbon and coal-derived solid hydrocarbon. As shown in FIG. 6, it can transported as a solid to be used as a feedstock in other industrial and chemical processes and applications. In addition, it may be used to prepare liquid hydrocarbon-based fuels, some of which are described in Examples 10-13.

Example 10

A two-phase, pumpable system of liquid hydrocarbon and coal-derived solid hydrocarbon was produced according to the hydrocarbon agglomeration procedure of Example 8. The liquid hydrocarbon present was greater than 40 vol. %.

Three different particle sizes of coal-derived solid hydrocarbon were produced: average size of 10 microns, average size of 1 micron, and average size of 0.1 microns.

A bimodal distribution of coal-derived solid hydrocarbon was used to make a pumpable two-phase liquid fuel composed of liquid hydrocarbon and coal-derived solid hydrocarbon particles with a lower liquid hydrocarbon content than a system with just one particle size. Filter cakes prepared according to the procedure of Example 9 of the large and medium particles were blended together in the amounts of about 65 vol. % and 22 vol. %, respectively, to produce a bimodal suspension of coal-derived hydrocarbon particles in liquid hydrocarbon. The liquid hydrocarbon amount ranged from about 15 vol. % to 22 vol. % depending on the desired viscosity of the pumpable fuel.

A trimodal distribution of coal-derived solid hydrocarbon is used to make a pumpable two-phase liquid fuel composed of liquid hydrocarbon and coal-derived solid hydrocarbon particles with a lower liquid hydrocarbon content than a system with just one particle size. Filter cakes of the large particles, medium particles, and small particles are prepared. These cakes are blended together in the amounts of about 65 vol. % large particles, 22 vol. % medium particles, and 8 vol % small particles to produce a trimodal suspension of liquid hydrocarbon and coal-derived hydrocarbon. A trimodal distribution of coal-derived solid hydrocarbon is used to make a pumpable two-phase liquid fuel composed of liquid hydrocarbon and coal-derived solid hydrocarbon particles with a lower liquid hydrocarbon content than a system with just one particle size. The liquid hydrocarbon content ranged from about 7 vol. % to 12 vol. % depending on the targeted viscosity.

Example 11

Coal-derived solid hydrocarbon particles were blended with ethanol to make a two-phase, pumpable liquid fuel. Single particle distribution, bimodal particle distribution, and trimodal distribution can be employed depending on the targeted viscosity and the amount of solid particles or liquid ethanol desired by the end user. The two phase liquid fuel consisting of ethanol and coal-derived solid hydrocarbons is an example of blending a renewable fuel such as ethanol with coal-derived solid hydrocarbons to reduce the consumption of ethanol and increase the energy content of the liquid fuel. Other liquid biofuels could also be used, such as biodiesel.

Example 12

Coal-derived solid hydrocarbon was blended with gasoline, fuel oils such as kerosene or diesel, or residual fuel oils to make a two-phase, pumpable liquid fuel. Single particle distribution, bimodal particle distribution, and trimodal distribution can be employed depending on the targeted viscosity and the amount of solid particles or liquid hydrocarbon desired by the end user. The new two phase pumpable liquid fuel of liquid hydrocarbon and coal-derived solid hydrocarbon could find use as replacements for their single phase counterparts in industrial applications.

Example 13

Coal-derived solid hydrocarbon was mixed with crude oil to make a two-phase, pumpable liquid fuel. Single particle distribution, bimodal particle distribution, and trimodal distribution can be employed depending on the targeted viscosity and the amount of solid particles or crude oil desired by the end user. The new two phase pumpable liquid fuel of crude oil and coal-derived solid hydrocarbon can be used as the feedstock into an oil refinery. In this case, volatile matter in the coal is extracted and refined along with various liquid fractions in the crude oil.

Example 14

Figure 7:
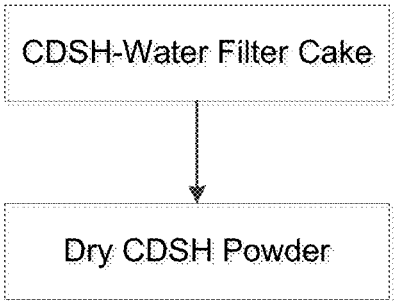
FIG. 7 is a flow diagram of a disclosed process for obtaining dry coal-derived solid hydrocarbon powder.

Referring to FIG. 7, the CDSH-water filter cake from Example 4 was a two-phase system composed of coal-derived solid hydrocarbon and liquid water. This filter cake was introduced into a powder dryer to produce a fine powder of coal-derived solid hydrocarbon. The fine powder was a single phase system consisting of particles of coal-derived solid hydrocarbon fuel. This powdered coal-derived solid hydrocarbon can be used as a feedstock into other industrial, chemical, and energy processes and applications.

Example 15

Fine powdered coal-derived solid hydrocarbon, prepared according the procedure of Example 14, was injected directly into a combustor, such as a pulse jet, via a powder delivery system, such as an auger. The dense powder fuel of coal-derived solid hydrocarbon was burned directly. The energy produced was used to heat a manure dryer.

Example 16

Fine powdered coal-derived solid hydrocarbon, prepared according the procedure of Example 14, was entrained in air and transported in the air. This air with entrained coal-derived solid hydrocarbon particles was injected directly into a combustor such as a boiler to produce heat. The energy in the heat can then be harnessed for the purpose for which the boiler was designed, be that heat exchange, drying, energy production, etc. In this manner, air, which has no caloric value, now has caloric value depending upon the amount of entrained coal-derived solid hydrocarbon.

Example 17

Fine powdered coal-derived solid hydrocarbon, prepared according the procedure of Example 14, was evacuated in a vacuum chamber to remove all of the air and leave behind only the solid particles of coal-derived solid hydrocarbon. The chamber was refilled with natural gas and pressurized. As the natural gas was released from the pressurized chamber, coal-derived solid hydrocarbon was entrained in the natural gas. The heat content of natural gas can be increased significantly by entraining small vol. % of coal-derived solid hydrocarbons. The two phase system of natural gas and coal-derived solid hydrocarbon provides increased heat content in comparison to natural gas alone can be transported in the same lines in which natural gas is currently transported.

Figure 8:
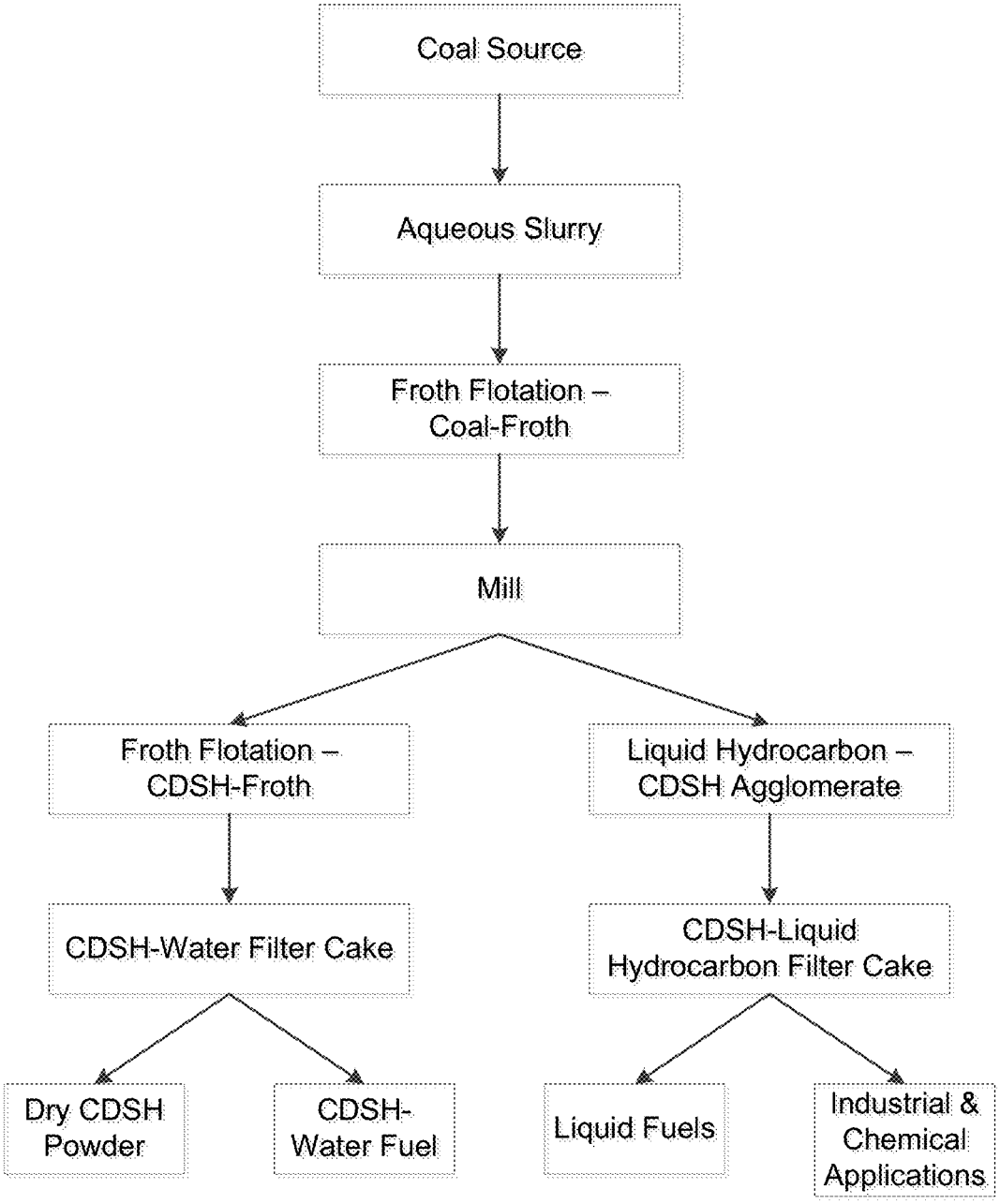
FIG. 8 is a flow diagram relating to processes for obtaining and utilizing coal-derived solid hydrocarbon in which an initial froth flotation occurs prior to milling.
Figure 9:
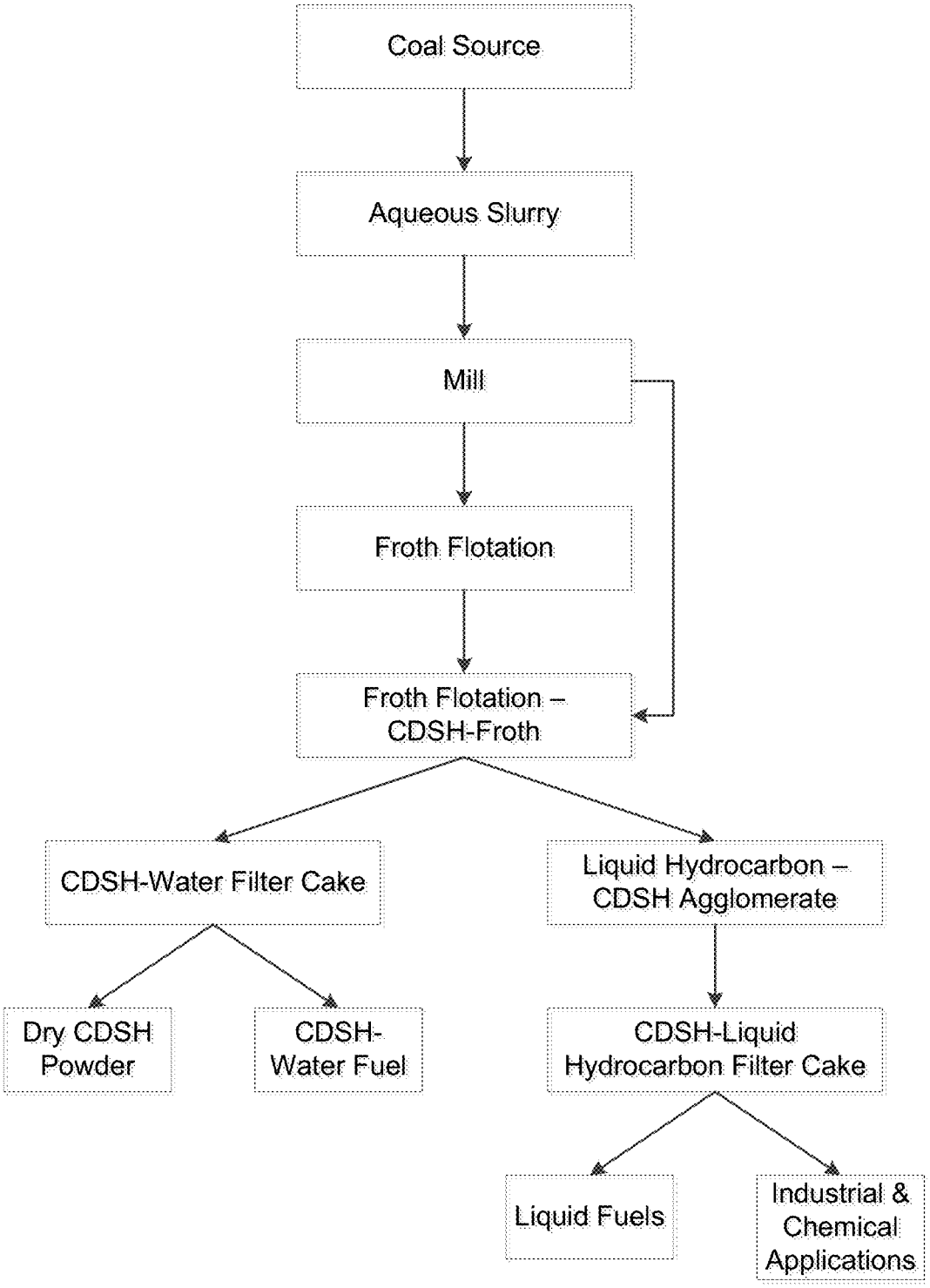
FIG. 9 is a flow diagram relating to processes for obtaining and utilizing coal-derived solid hydrocarbon in which milling occurs prior to an initial froth flotation.

FIG. 8 is a flow diagram relating to processes for obtaining and utilizing coal-derived solid hydrocarbon in which an initial froth flotation occurs prior to milling. It includes elements from FIGS. 1 and 4-7. FIG. 9 is a flow diagram relating to processes for obtaining and utilizing coal-derived solid hydrocarbon in which milling occurs prior to an initial froth flotation. It includes elements from FIGS. 2-7.

Example 18

Polished thin sections of coal particles were made. The coal particles were obtained via froth flotation of coal refuse. Two coal samples were used: refuse containing Appalachian Pocahontas seam metallurgical grade coal and refuse containing an Australian metallurgical grade coal. The thin sections were prepared by embedding the coal particles (dried froth) in an epoxy matrix and allowing it to cure. A glass slide was used as a carrier of the epoxy matrix. The thin section was then polished such that a polished cross section of particles was at the surface of the epoxy thin section.

Scanning electron microscopy with back scatter imaging (SEM-BSI) was done on the polished thin sections of fine coal particles embedded in an epoxy matrix. Heavier elements backscatter electrons more than lighter elements. The backscatter detector measures more electrons from silicon than carbon, for example, because silicon has a higher molecular weight. The coal and coal-derived solid hydrocarbon particles are composed largely of carbon. The epoxy is composed of carbon. The mineral matter particles have silicon, alumina, and iron in them.

In the images from SEM-BSI of the thin section of coal particles, coal-derived solid hydrocarbon particles and epoxy matrix appear gray. Sometimes a coal particle edge and a CDSH edge is indistinguishable from the epoxy matrix because both are carbon based and there is little contrast. The edges of coal particles can usually be distinguished for larger particles. In an SEM-BSI image, the mineral matter appears white because the larger molecular weight elements scatter more electrons back at the detector.

Figure 10A:
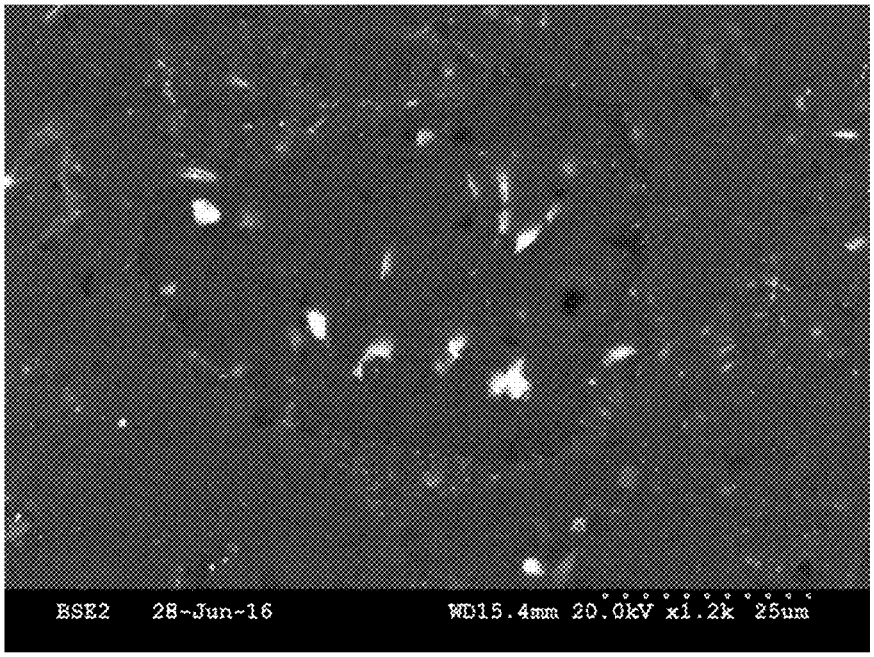
FIGS. 10A-10E are SEM-BSI images of Appalachian Pocahontas seam metallurgical grade coal particles with diameters ranging from 25 to 100 μm.
Figure 10B:
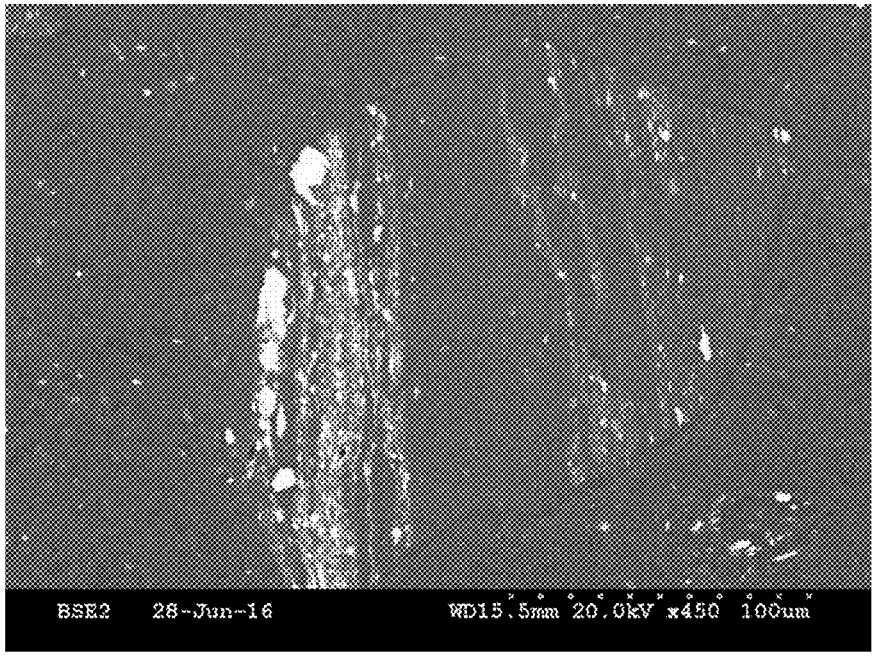
Figure 10C:
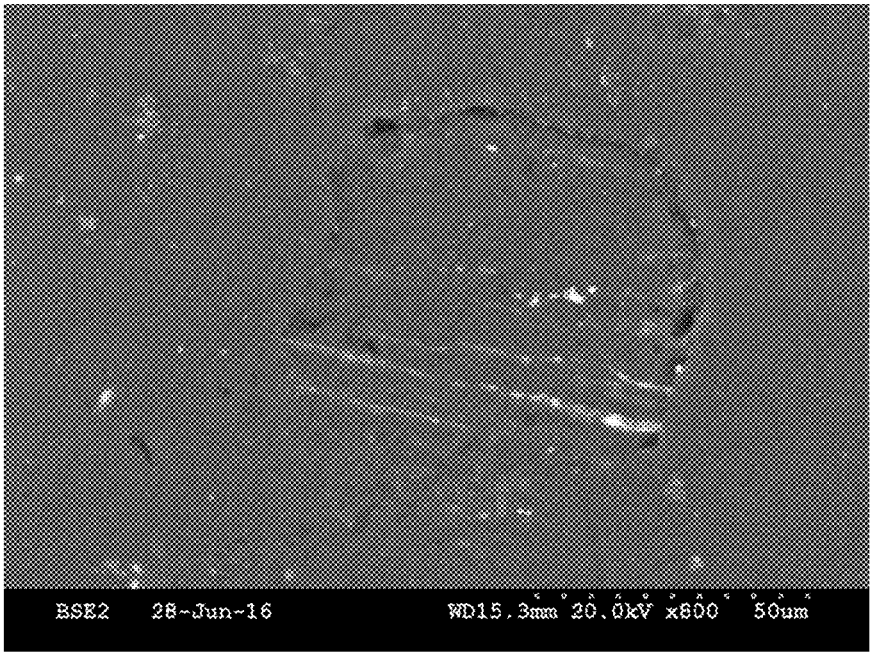
Figure 10D:
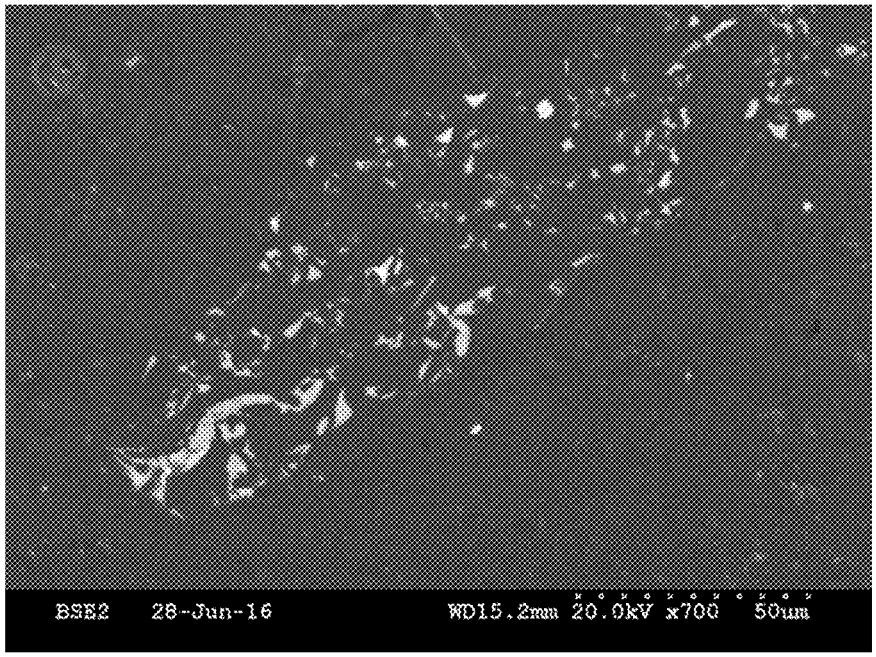
Figure 10E:
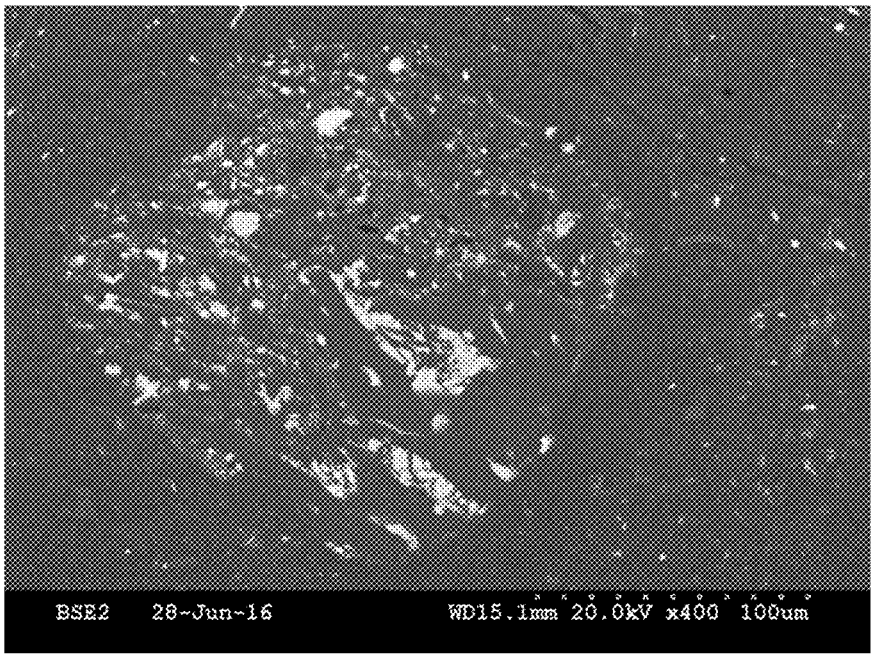
Figure 10F:
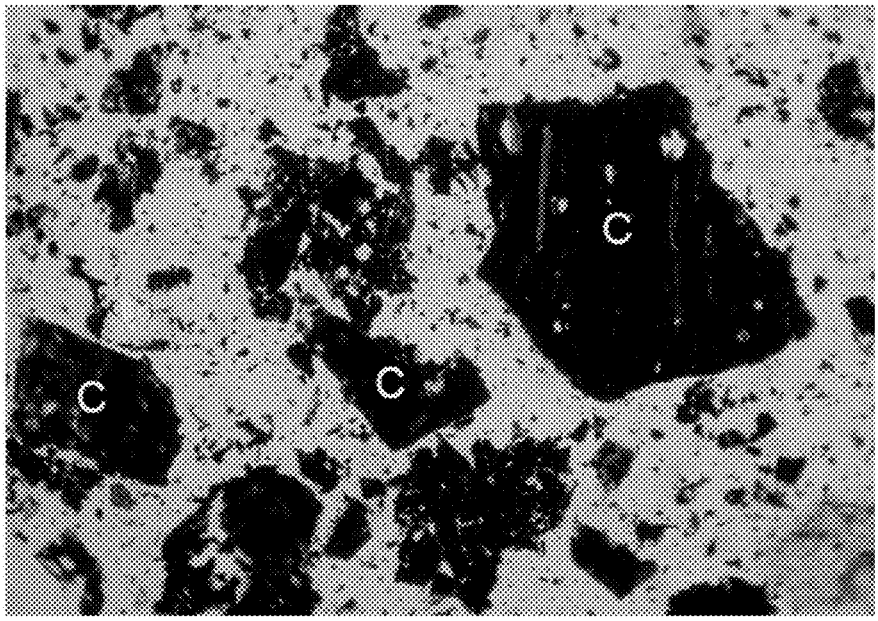
FIG. 10F is an optical micrograph of the Appalachian Pocahontas coal particles where the left to right distance is 380 μm.
Figure 11A:
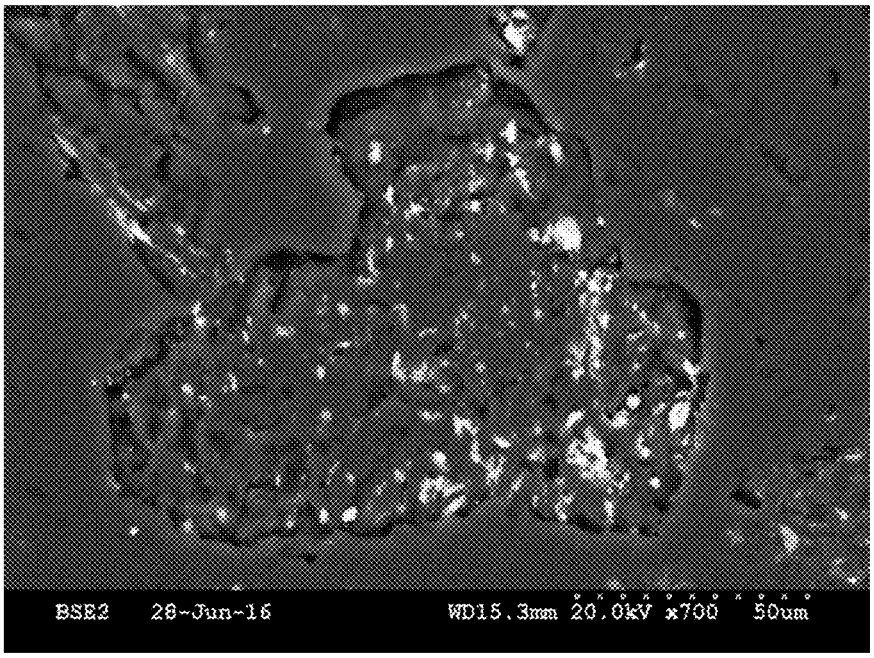
FIGS. 11A-11C are SEM-BSI images of Australian seam metallurgical grade coal particles with diameters ranging from 50 to 200 μm.
Figure 11B:
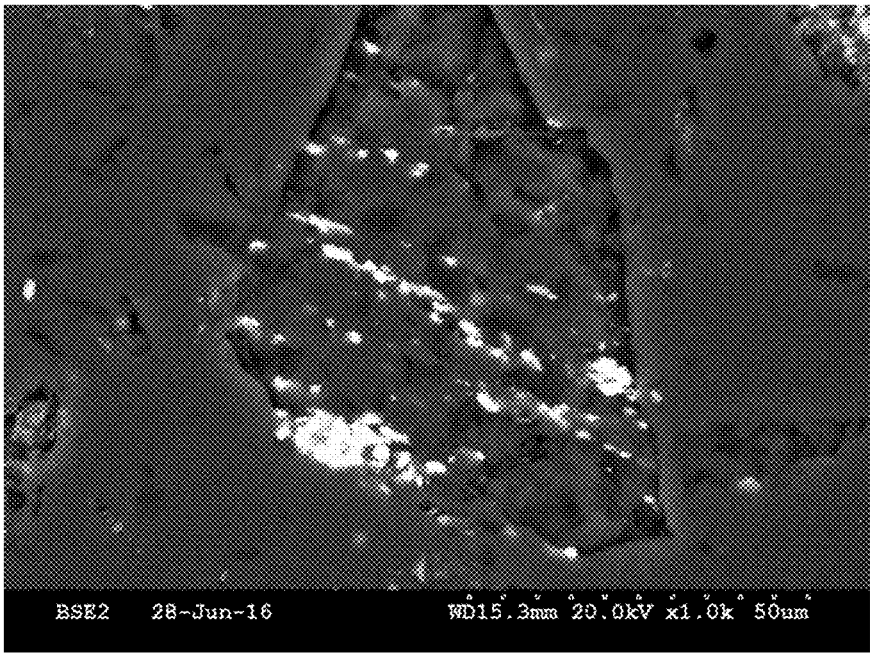
Figure 11C:
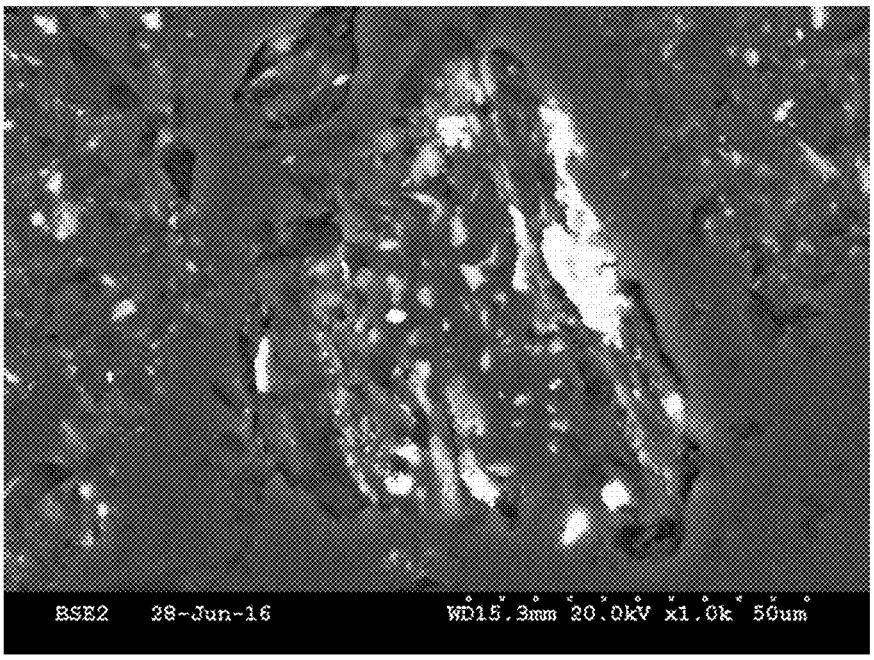
Figure 11D:
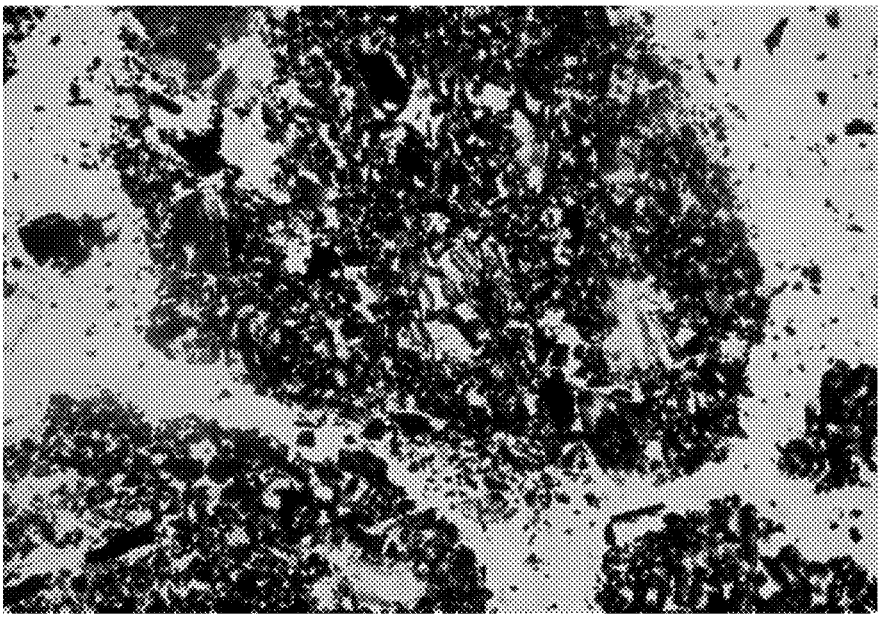
FIG. 11D is an optical micrograph of the Australian coal particles where the left to right distance is 380 μm.

FIGS. 10A-10E show SEM-BSI images of coal particles ranging between 25 microns to 100 microns in diameter for the Appalachian Pocahontas metallurgical coal particles obtained via froth flotation. An optical micrograph of the thin section sample is included as a reference in FIG. 10F. FIGS. 11A-11C show SEM-BSI images of coal particles ranging between 50 microns and 200 microns in diameter for the Australian metallurgical coal particles. An optical micrograph of the thin section sample is included as a reference in FIG. 11D. There are a few white particles outside of the edges of the coal particles, but in general, the images show that individual and discrete mineral matter particles have largely been removed from the coal particles via froth flotation. However, as the cross section images of the coal particles show, the white which is indicative of the mineral matter, is an integral part of the coal particles. In other words at this particle size, mineral matter remains entrained in the coal particles. The images show that the mineral matter entrainment is sometimes evident as a thin sediment layer and sometimes as aggregates.

Figure 12A:
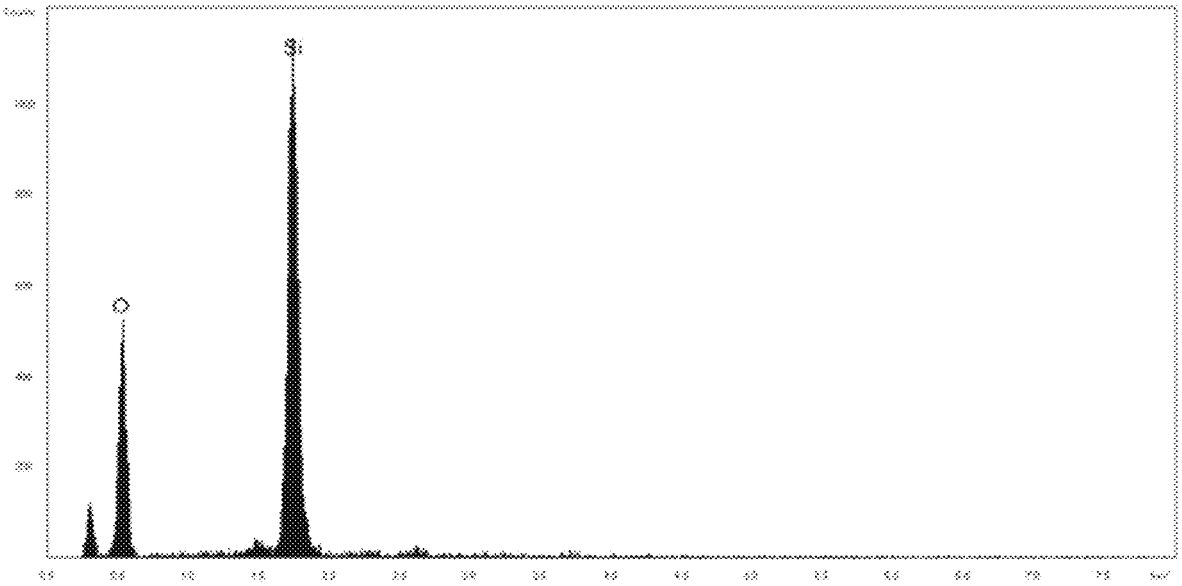
FIG. 12A is a SEM-EDX spectrum of a fine silt-size mineral matter inclusion of the coal particles having an elemental composition consistent with quartz ($SiO_2$).
Figure 12B:
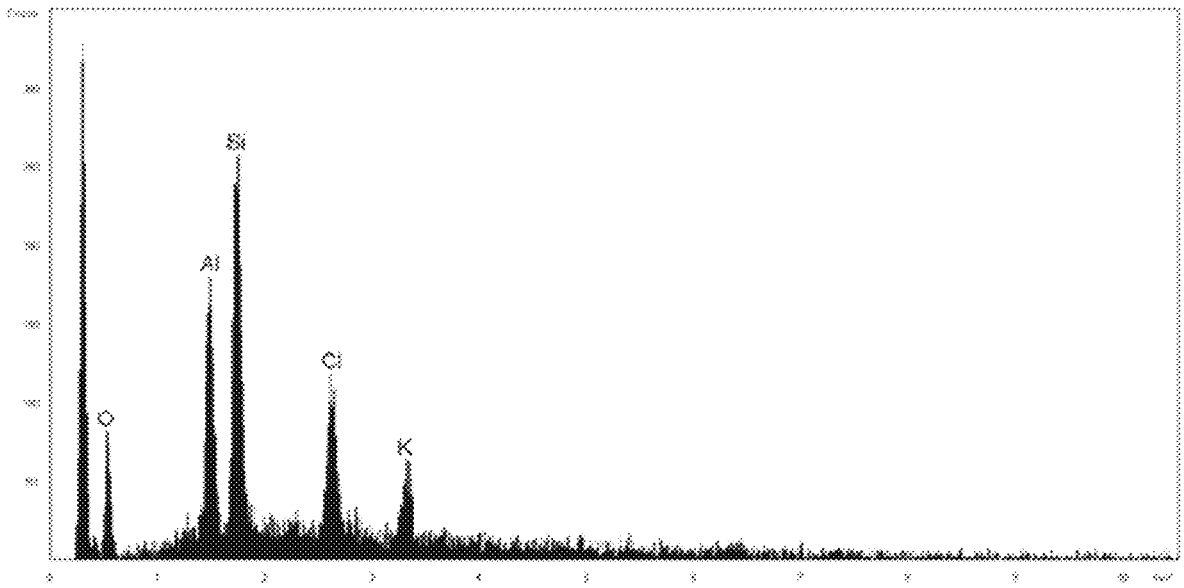
FIG. 12B is a SEM-EDX spectrum of another fine silt-size mineral matter inclusion of the coal particles having an elemental composition consistent with an illite-sericite type of clay. The presence of chlorine (Cl) is due to the epoxy used to impregnate the sample.

Scanning electron microscopy with energy dispersive X-ray spectroscopy (SEM-EDX) was focused over some of the white spots observed in SEM-BSI to verify the white spots were in fact mineral matter and not charging effects. Results indicative of $SiO_2$ (FIG. 12A) and illite-sericite type of clay (FIG. 12B) were found, both of which are consistent with the nature of the mineral matter in coal.

Figure 13A:
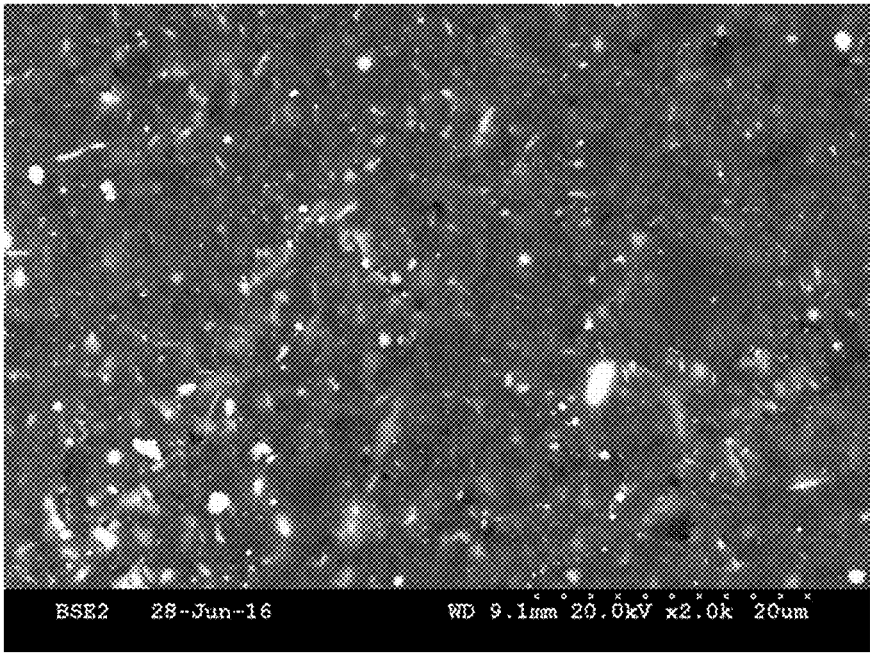
FIG. 13A is an SEM-BSI image of Appalachian Pocahontas seam metallurgical grade coal particles with diameters less than 5 μm.
Figure 13B:
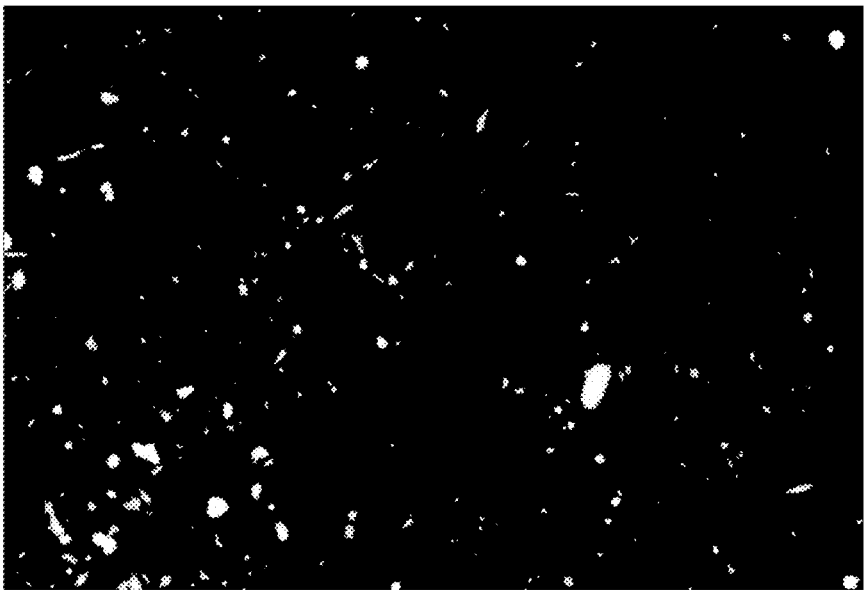
FIG. 13B is the SEM-BSI image of FIG. 13A processed with thin-section analysis software.
Figure 14A:
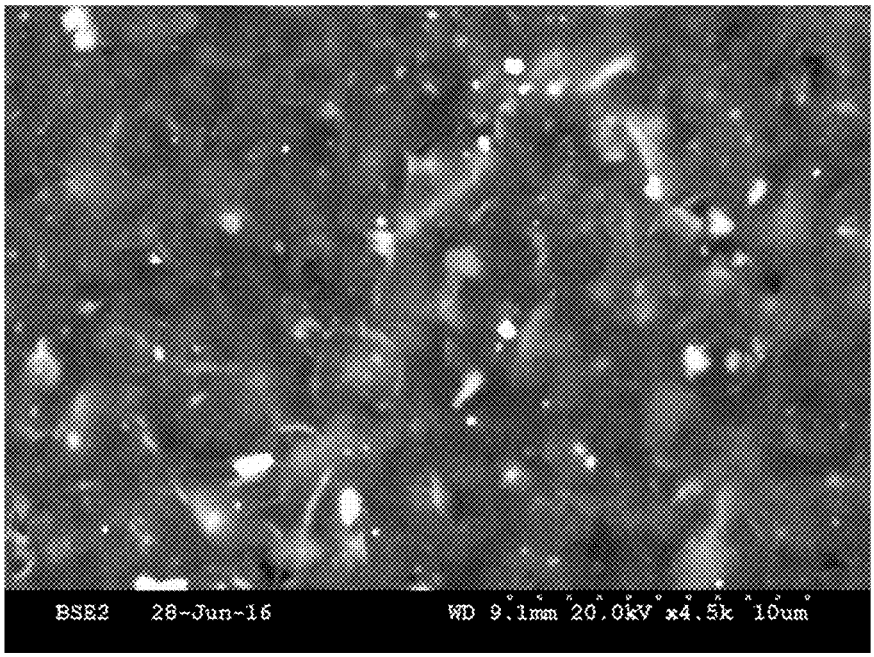
FIG. 14A is an SEM-BSI image of Australian seam metallurgical grade coal particles with diameters less than 5 μm.

FIG. 13A show SEM-BSI images of fine particles obtained by milling Appalachian Pocahontas metallurgical coal particles obtained via froth flotation to diameters less than (d99) 5 microns. The average diameter was about 1.5 microns. FIG. 14A show SEM-BSI images of fine particles obtained by milling Australian metallurgical coal particles obtained via froth flotation to d99 of 5 microns. The diameter was about 1.5 microns. An optical micrograph of the thin section sample is included as a reference in FIG. 14C. In the optical micrograph of the thin section of the d99 5 micron particles, the fine particles are very tightly packed in the polished thin section leaving very little epoxy visible between the coal particles. The scale for SEM-BSI image of the d99, 5 micron particles in FIG. 13A-13B is 20 microns. The scale for SEM-BSI image of the d99, 5 micron coal particles in FIG. 14A-14B is 10 microns.

In the SEM-BSI images in FIG. 10A-10F and FIGS. 11A-11D of coal particle ranging in diameters from about 25 microns to 200 microns, the presence of entrained or embedded mineral matter at times helped define the edges, and thus size, of the coal particles. In the SEM-BSI images of the d99, 5 micron particles in FIGS. 13A-13B and FIGS. 14A-14B, the mineral matter particles are no longer useful in defining the fine coal particles. Instead, the white spots indicating the mineral matter particles are seen to be individual and discrete and are the same size as all other particles in the SEM-BSI image. The particles that are carbon based are now very small (diameters of d99, 5 microns and about 1.5 microns on average) making it difficult to distinguish the fine carbon-based particles from the carbon-based epoxy matrix. Instead, slight contrast differences and blur are observed as the epoxy and individual and discrete carbon-based particles surround the individual and discrete mineral matter particles. The individual and discrete carbon-based particles now contain no entrained mineral matter. In other words, they are a solid hydrocarbon material that has been purified and produced from the raw material commonly known as coal. This new solid hydrocarbon material is referred to as coal-derived solid hydrocarbon.

Figure 14B:
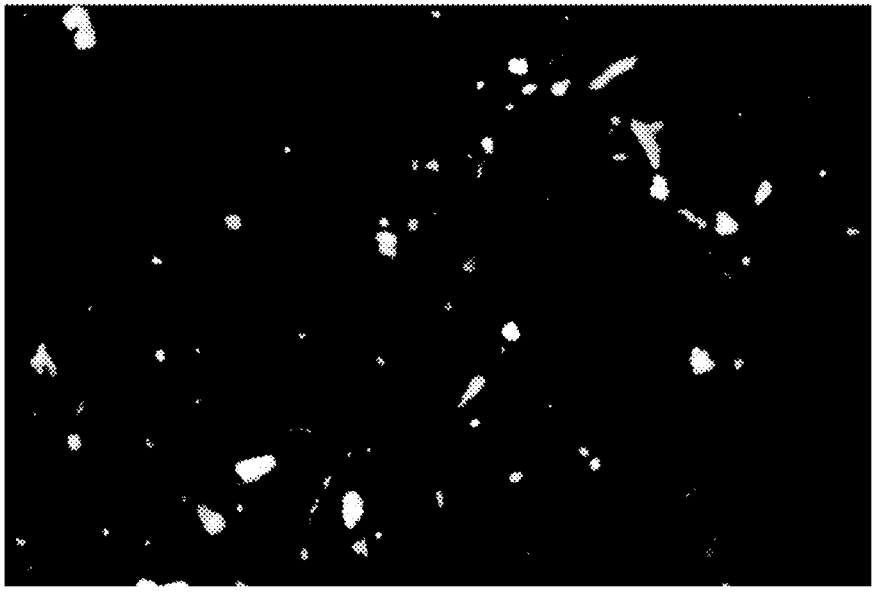
FIG. 14B is the SEM-BSI image of FIG. 14A processed with thin-section analysis software.
Figure 14C:
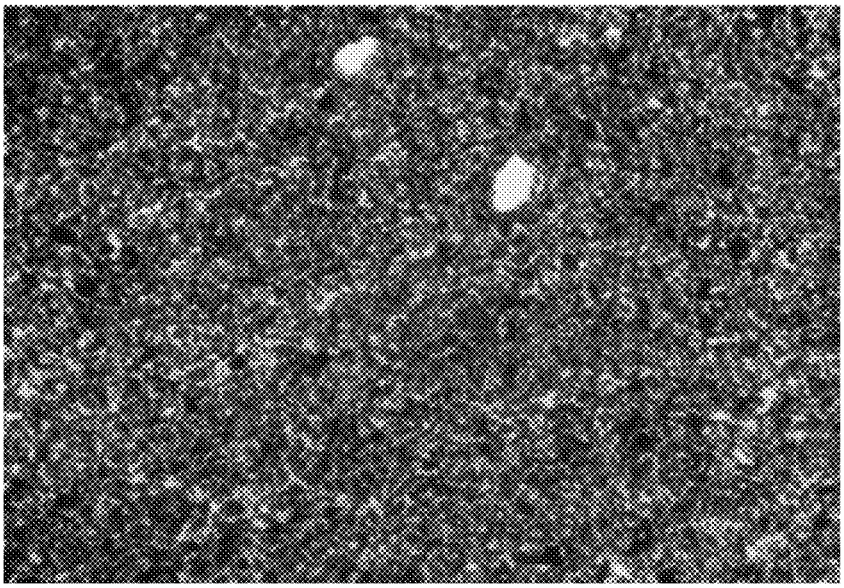
FIG. 14C is an optical micrograph the Australian coal particles where the left to right distance is 380 μm.
Figure 12A:
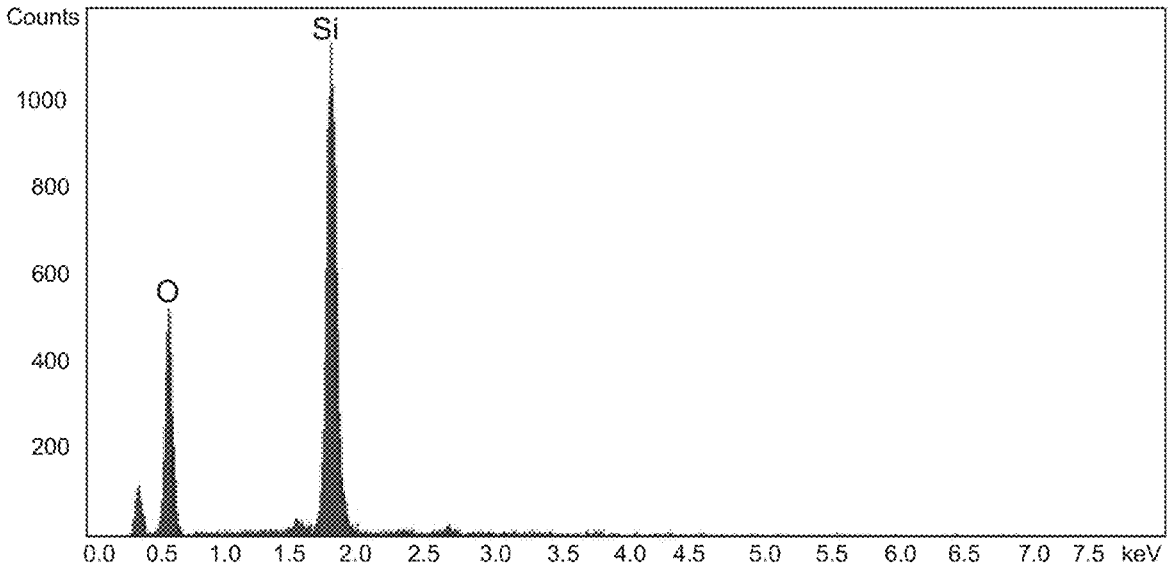
Figure 12B:
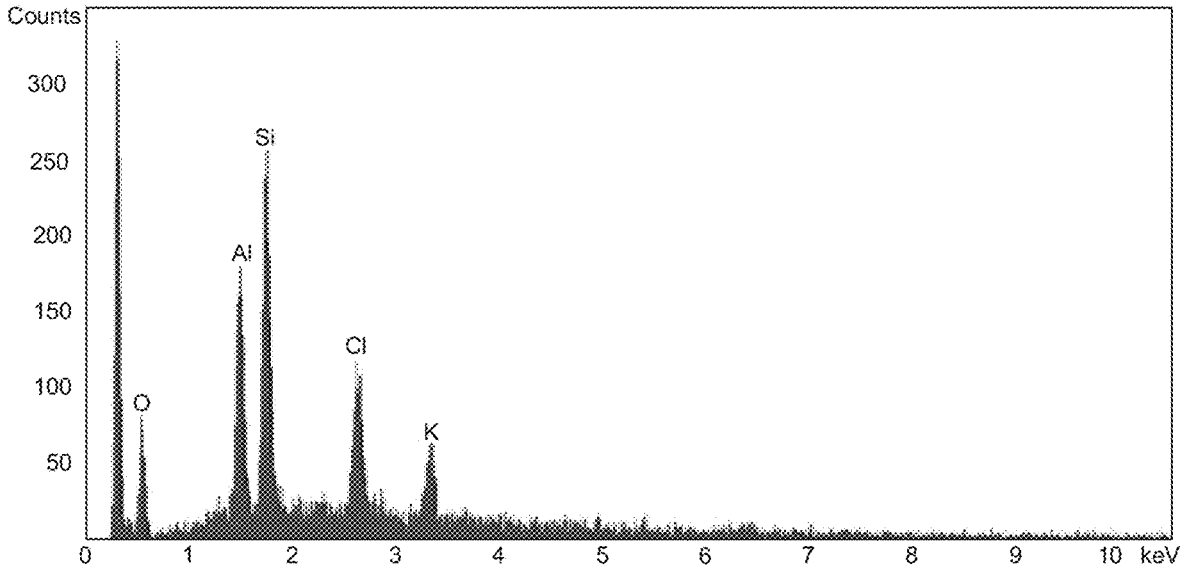

The SEM-BSI images of the d99 of 5 micron particles in FIGS. 13B and 14B were processed with the JMicroVision thin section analysis software to highlight the white areas indicative of mineral matter. In both cases, about 2% of the area was found to be mineral matter. The ash-forming mineral matter content of the froth that was milled to d99 of 5 microns was 4 to 5 wt. % mineral matter for both the Appalachian and the Australian metallurgical grade coal samples. Since the mineral matter particles are about twice as dense as the solid hydrocarbon particles, the ash mineral matter content one would predict when about 2% of the cross-sectional area is mineral matter particles would be in the range of about 4% mineral matter.

These samples of d99 of 5 microns Appalachian and the Australian metallurgical grade coal samples were then processed further by methods described in this paper to produce coal derived solid hydrocarbon products that were measured to be less than 1 wt. % ash, usually about 0.5 wt. % ash.

The above described process produces very fine coal-derived solid hydrocarbon particles that may have discrete unseparated coal-derived mineral matter particles ranging from about 0.5 wt. % to 1.5 wt. %. As the size of the coal-derived carbonaceous matter particles drops below 10 to 20 microns and the inherent mineral matter content drops below 1 wt. %, the material changes from the natural raw material commonly called coal or composite coal herein, to a manufactured material referred to herein as coal-derived solid hydrocarbon.

It will be appreciated that the coal-derived solid hydrocarbon disclosed herein is a new, refined material that may be used in a variety of different industrial, chemical, and energy applications. The described embodiments and examples for the use of coal-derived solid hydrocarbon are to be considered in every respect as illustrative only, and not as being restrictive. The scope of the invention is, therefore, indicated by the appended claims, rather than by the foregoing description. All changes that come within the meaning and range of equivalency of the claims are to be embraced within their scope.

The invention claimed is:

1. Coal-derived solid hydrocarbon particles consisting of coal-derived carbonaceous matter free of entrained mineral matter, wherein the coal-derived solid hydrocarbon particles have a particle size less than 20 μm and an average particle size in the range from 1 μm to 4 μm, wherein the coal-derived solid hydrocarbon particles are combined with a liquid hydrocarbon and the combination is present in a filter cake.

2. Coal-derived solid hydrocarbon particles according to claim 1, wherein the liquid hydrocarbon is selected from kerosene, diesel, fuel oil, and crude oil.

3. Coal-derived solid hydrocarbon particles consisting of coal-derived carbonaceous matter free of entrained mineral matter, wherein the coal-derived solid hydrocarbon particles have a particle size less than about 20 μm and an average particle size in the range from 1 μm to 4 μm, wherein the coal-derived solid hydrocarbon particles are blended with a hydrocarbon fuel to form a two-phase hydrocarbon fuel.

4. Coal-derived solid hydrocarbon particles according to claim 3, wherein the hydrocarbon fuel is liquid.

5. Coal-derived solid hydrocarbon particles according to claim 3, wherein the hydrocarbon fuel is gaseous.

6. Coal-derived solid hydrocarbon particles consisting of coal-derived carbonaceous matter free of entrained mineral matter, wherein the coal-derived solid hydrocarbon particles have a particle size less than about 20 μm and an average particle size in the range from 1 μm to 4 μm, wherein the coal-derived solid hydrocarbon particles are blended with water to form a two-phase liquid fuel.

7. Coal-derived solid hydrocarbon particles according to claim 1, wherein the coal-derived solid hydrocarbon particles have a particle size less than about 10 μm.

8. Coal-derived solid hydrocarbon particles consisting of ultrafine particles of coal-derived carbonaceous matter free of entrained mineral matter, wherein the coal-derived solid hydrocarbon particles are blended with a hydrocarbon fuel to form a two-phase hydrocarbon fuel.

9. Coal-derived solid hydrocarbon particles according to claim 8, wherein the coal-derived solid hydrocarbon particles have a particle size less than about 20 μm.

10. Coal-derived solid hydrocarbon particles according to claim 8, wherein the coal-derived solid hydrocarbon particles have an average particle size in the range from 1 μm to 8 μm.

11. Coal-derived solid hydrocarbon particles according to claim 8, wherein the coal-derived solid hydrocarbon particles have a particle size less than about 20 μm and have an average particle size in the range from 1 μm to 8 μm.

12. Coal-derived solid hydrocarbon particles according to claim 8, wherein the hydrocarbon fuel is liquid.

13. Coal-derived solid hydrocarbon particles according to claim 8, wherein the hydrocarbon fuel is gaseous.

14. Coal-derived solid hydrocarbon particles consisting of ultrafine particles of coal-derived carbonaceous matter free of entrained mineral matter, wherein the coal-derived solid hydrocarbon particles are blended with water to form a two-phase liquid fuel.

15. Coal-derived solid hydrocarbon particles consisting of ultrafine particles of coal-derived carbonaceous matter free of entrained mineral matter, wherein the coal-derived solid hydrocarbon particles are suspended with air to form a two-phase gaseous fuel.

16. Coal-derived solid hydrocarbon particles consisting of coal-derived carbonaceous matter free of entrained mineral matter, wherein the coal-derived solid hydrocarbon particles have a particle size less than about 20 μm and an average particle size in the range from 1 μm to 4 μm, wherein the coal-derived solid hydrocarbon particles are suspended with air to form a two-phase gaseous fuel.

17. Coal derived solid hydrocarbon particles according to claim 5, wherein the gaseous hydrocarbon fuel is selected from natural gas, methane, propane, and butane.

18. Coal derived solid hydrocarbon particles according to claim 13, wherein the gaseous hydrocarbon fuel is selected from natural gas, methane, propane, and butane.

19. Coal-derived solid hydrocarbon particles according to claim 3, wherein the coal-derived solid hydrocarbon particles have a particle size less than about 10 μm.

20. Coal-derived solid hydrocarbon particles according to claim 8, wherein the coal-derived solid hydrocarbon particles have a particle size less than about 10 μm.

* * * * *